US006620582B2

(12) United States Patent
Hirabayashi

(10) Patent No.: US 6,620,582 B2
(45) Date of Patent: Sep. 16, 2003

(54) THERMALLY DEVELOPABLE PHOTOTHERMOGRAPHIC MATERIAL FOR MAKING A PRINTING PLATE, PRINTING PLATE MADE THEREOF AND PREPARATION METHOD THEREOF

(75) Inventor: Kazuhiko Hirabayashi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/025,078

(22) Filed: Dec. 19, 2001

(65) Prior Publication Data

US 2002/0142254 A1 Oct. 3, 2002

(30) Foreign Application Priority Data

Dec. 25, 2000 (JP) ..... 2000/392496

(51) Int. Cl.[7] ..... G03C 1/498

(52) U.S. Cl. ..... 430/619; 430/264; 430/300; 430/523; 430/620

(58) Field of Search ..... 430/523, 619, 430/264, 620, 300

(56) References Cited

U.S. PATENT DOCUMENTS 6,132,949 A * 10/2000 Fujita et al. ..... 430/619

FOREIGN PATENT DOCUMENTS

| | | |
|---|---|---|
| EP | 0321161 | 6/1989 |
| EP | 0742491 | 11/1996 |
| EP | 0770910 | 5/1997 |
| EP | 0895122 | 2/1999 |
| EP | 1037102 | 9/2000 |

* cited by examiner

*Primary Examiner*—Thorl Chea
(74) *Attorney, Agent, or Firm*—Muserlian, Lucas and Mercanti

(57) ABSTRACT

A photothermographic light-sensitive material for making a printing plate comprising a support having thereon a light-sensitive layer containing light-sensitive silver halide grains, organic silver salt grains, a reducing agent and a binder, wherein the organic silver salt grain comprises a organic silver salt having 10 or more of carbon atoms and the photothermographic light-sensitive material has an outermost layer at a light-sensitive layer side of the support having a coefficient of water absorption of not less than 0.7%.

6 Claims, 1 Drawing Sheet

Figure 1:
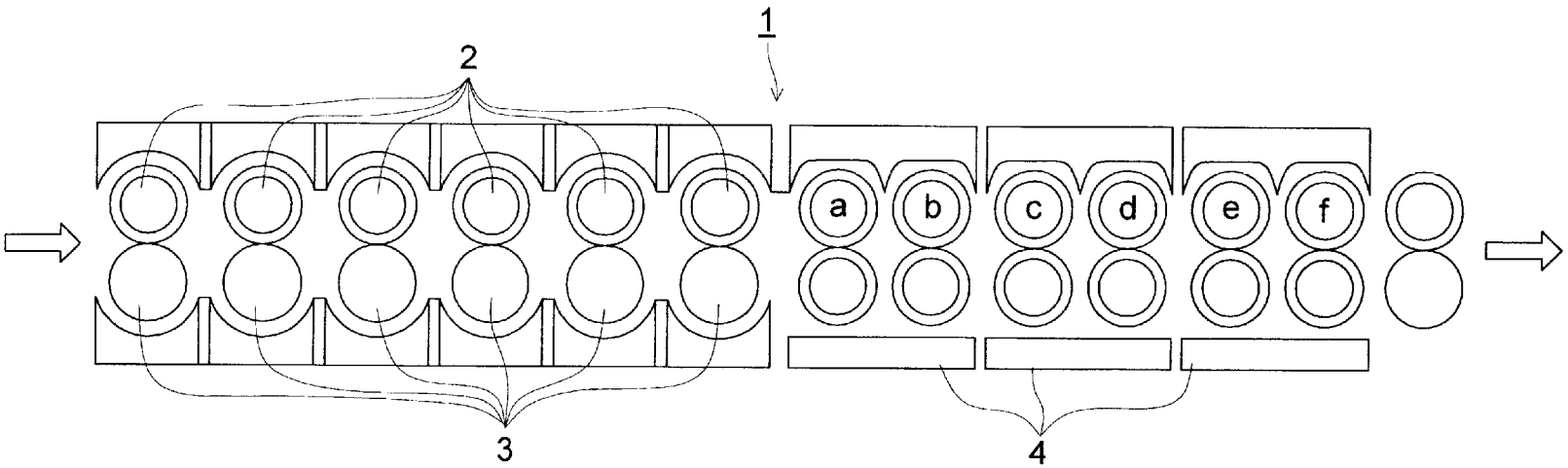

THERMALLY DEVELOPABLE PHOTOTHERMOGRAPHIC MATERIAL FOR MAKING A PRINTING PLATE, PRINTING PLATE MADE THEREOF AND PREPARATION METHOD THEREOF

FIELD OF THE INVENTION

The present invention relates to a thermally developable photothermographic light-sensitive material for making a printing plate (hereinafter, also referred to as a thermally developable photothermographic material or simply as photothermographic material), having high sensitivity and not employing wet processing, a printing plate made thereof and a preparation method thereof.

BACKGROUND OF THE INVENTION

Up to this time, in the field of production of printing plate or of medical diagnosis, effluents accompanying the wet processing of image forming materials have become a problem in terms of operating properties, and recently, the reduction of processing effluents has been strongly desired also in terms of protection of environment and space saving.

Specifically, in the field of production of printing plate, the digitization of characters and images has been evidenced by much progress, and the interest in CTP (Computer To Plate), in which a printing plate is directly exposed without using prepress films, has increased greatly. However, the present CTP system, as a commercially available product on the market does not yet satisfy all of requirements with respect to processing speed, quality, working environment, etc. For example, a CTP system of a silver salt diffusion transfer type has a high exposure speed, but unfortunately has many problems in working environment, treatment of effluent and management of processing solutions due to the wet-type processing method which uses a developing solution. As a thermally developable type using a dampening solution, for example, even the two-sheet type CTP system (composed of a peelable sheet and a printing plate) described in such as JP-A 8-314143 and 8-314144 (JP-A refers to an unexamined and published Japanese Patent Application) has disadvantages of producing much waste material during use and short plate life of the printing plate surface.

On the other hand, a CTP system called a thermal type has a low sensitivity as the printing plate material requiring a high-powered laser for image formation, and consequently, it is difficult to increase the exposure speed. Further, some of this type requires pre-heating, which causes fluctuation in quality depending on the progress of heating until the development.

As a completely dry type system applicable to printing plates, there is a method in which the film surface is destroyed and peeled off utilizing a high-powered laser exposure; however, this equipment is expensive, the pieces of blown film may remain on the printing plate causing smudges in the non-image area, and further this system has the disadvantage of lower resolution.

As described above, presently, there is no complete dry type printing plate which is satisfactory with respect to the productivity as well as quality, therefore the requirements of the market have not been satisfied yet.

SUMMARY OF THE INVENTION

The invention has been achieved in consideration of the aforementioned problems. The object of the invention is to provide a thermally developable photothermographic material for making a printing plate, having high sensitivity without being subjected to wet processing, superior characteristics as a printing plate with respect to smudging in non-image areas, opening of shadow screen dots, recovery from smudge, as well as sufficient printing life; a printing plate made thereof and a preparation method of the printing plate.

The object of the invention has been achieved by the following constitution.

[Structure 1]

A photothermographic light-sensitive material for making a printing plate comprising a support having thereon a light-sensitive layer containing light-sensitive silver halide grains, organic silver salt grains, a reducing agent and a binder, wherein the organic silver salt grains comprise a organic silver salt having 10 or more of carbon atoms and the photothermographic light-sensitive material has an outermost layer at a light-sensitive layer side of the support having a coefficient of water absorption of not less than 0.7%.

[Structure 2]

The photothermographic light-sensitive material of Structure 1, wherein the outermost layer is the light-sensitive layer.

[Structure 3]

The photothermographic light-sensitive material of Structure 1, wherein the outermost layer is a light-insensitive layer.

[Structure 4]

The photothermographic light-sensitive material of Structure 3, wherein the thickness of the light-insensitive layer is within a range of 0.02 $\mu$m to 1.2 $\mu$m.

[Structure 5]

The photothermographic light-sensitive material of Structure 4, wherein the thickness of the light-insensitive layer is within a range of 0.05 $\mu$m to 1.0 $\mu$m.

[Structure 6]

The photothermographic light-sensitive material of Structure 1, wherein the coefficient of water absorption of the outermost layer is within a range of 1.5% to 50%.

[Structure 7]

The photothermographic light-sensitive material of Structure 1, wherein the light-sensitive layer has a contrast increasing agent.

[Structure 8]

A photothermographic light-sensitive material for making a printing plate comprising a support having thereon a light-sensitive layer containing light-sensitive silver halide grains, organic silver salt grains, a reducing agent and a binder and an outermost light-insensitive layer on the light-sensitive layer, wherein the organic silver salt grains comprise a organic silver salt having 10 or more of carbon atoms and the light-sensitive layer has a coefficient of water absorption of not less than 0.7% and the outermost light-insensitive layer has a coefficient of water absorption of not more than 0.7% and a thickness within a range of 0.005 $\mu$m to 0.5 $\mu$m.

[Structure 9]

The photothermographic light-sensitive material of Structure 8, wherein the light-sensitive layer has a contrast increasing agent.

[Structure 10]

The photothermographic light-sensitive material of Structure 8, wherein thickness of the light-insensitive layer is with in a range of 0.01 $\mu$m to 0.2 $\mu$m.

[Structure 11]

A printing plate prepared by a method comprising steps of:

exposing the photothermographic light-sensitive material of Structure 1, subjecting the exposed photothermographic light-sensitive material to a thermal development.

[Structure 12]

The printing plate of Structure 11, wherein the printing plate has an exposed area and an unexposed area on the surface, and the exposed area and the unexposed area have different contact angles against water each other.

BRIEF OF THE DRAWING

FIG. 1

The vertical sectional drawing of an example of the thermal development apparatus used in the invention.

DETAILED DESCRIPTION OF THE INVENTION

In general, to prepare a printing plate, it is necessary to imagewise form a hydrophilic portion and a hydrophobic portion on the printing plate surface and in this invention, as a result of extensive studies on the above problems, attention has been given to a hydrophobic organic compound (for example, an organic acid) produced in image forming areas specifically using a thermally developable photothermographic material. Thus, it has been found that the aforementioned hydrophobic organic compound is produced concurrently with silver images formed in exposed areas during thermal development. Such a organic compound is a so-called wax, and the presence of the organic compound on the photothermographic material provides a water-repellant (or hydrophobic) property, rendering printing feasible. Further, it has been found that the water absorbing property of a light-sensitive or light-insensitive layer greatly affect conditions under which lithographic printing is effectively performed. Concretely, it was found that increasing water absorption of the surface of the photothermographic material enhanced hydrophilicity, an imaging area was made water-repellant by the foregoing organic compound, a non-imaging area was made hydrophilic by a hydrophilic binder and increasing the difference between both areas led to superior printing capabilities to accomplish the invention.

According to the invention, a printing plate can be obtained by exposing by use of an image-setter commonly used and subjecting to thermal development, therefore, at high productivity and high image quality level, without additional investment.

The invention will be detailed as follows.

The present invention relates a thermally developable photothermographic material for making a printing plate comprising a support having thereon a light-sensitive layer containing light-sensitive silver halide grains, organic silver salt grains including an organic silver salt having 10 or more carbon atoms, a reducing agent and a binder, wherein an outermost layer of the light-sensitive layer side with respect to the support exhibits a coefficient of water absorption of not less than 0.7%, and preferably 1.5 to 50%. The aforementioned outermost layer may be the aforementioned light-sensitive layer or a light-insensitive layer. The outermost layer is preferably a light-sensitive layer in terms of allowing the organic acid produced exposes areas to be effectively present at the surface of the photothermographic material.

The coefficient of water absorption according to the invention (hereinafter, also denoted as water absorption coefficient) is defined as a value determined by the following procedure. Thus, a sample having a size of 5 cm×5 cm and a thickness of 3.18 mm is prepared, and after vaporizing the solvents by allowing the sample to stand in a thermostat of 55° C. for 5 hrs., the sample is immersed into pure water of 23° C. for 24 hrs. Next, the weight (S) of the sample is measured after absorbing water drops on the both side of the sample by Kim-towel. Then, the sample was kept in a thermostat of 55° C. for 5 hrs. and the weight (D) of the sample is measured to calculate the water absorption coefficient according to the following equation.

Water absorption coefficient=(S−D)/D×100 (%)

Such methods described at page 297 to 323 in Point 1st edition of "Series for the Usage of JIS: Selection of Plastic Materials" edited by Japanese Standard Association, and in "Data Handbook of Optimal Selection Standard for Plastics, Rubbers and Adhesives" edited by Kaigai-Gijutu-Kenkyusho, although there may be some differences in the measuring objects can also be referred.

To adjust the water absorption coefficient of the light-sensitive layer or of the light-insensitive layer being present on the outer side of the light-sensitive layer to an intended value, although there is specifically no limitation, it can be achieved, for example, by suitably selecting the kind and amount of a binder or those of a cross-linking agent used in each component layer.

Binders usable in the invention are not specifically limited, and preferably include, for example, gelatin, low density epoxy resins, aluminum-filled epoxy resins, methyl methacrylate/styrene copolymers, polyurethane elastomers, polyarylsulfones, ionomer resins, styrene/butadiene copolymers, unmodified nylons, nylon-6, polymethacryl esters, unsatulated polyesters, polyarylsulfones, nitoro cellulose, polyvinyl butyral, cellulose butylateacetate, polyvinyl formal, cellulose propionate, cellulose acetate, cellulose nitrate, triacetyl cellulose, ethyl cellulose, acetylbutyl cellulose, polyvinyl alcohol, polyvinyl acetate, polyvinyl acetal, casein resins and polyacrylonitrile, and specifically preferably gelatin, methyl methacrylate/styrene copolymers, polyurethane elastomers, styrene/butadiene copolymer, nitrocellulose, polyvinyl butyral, butylacetyl cellulose, polyvinyl formal, cellulose propionate, cellulose acetate, cellulose nitrate, triacetyl cellulose, ethyl cellulose, acetylbutyl cellulose, polyvinyl alcohol and polyvinyl acetate.

Further, the cross-linking agents usable in the invention are not specifically limited, and various cross-linking agents commonly used in conventional photographic light-sensitive materials, for example, an aldehyde-type, epoxy-type, ethyleneimine-type, vinylsulfone-type, acryloyl type, carbodiimide-type cross-linking agents described in JP-A 50-96216 can be used. Preferable are isocyanate-type compounds, epoxy-type compounds and acid anhydrides.

In the invention, superior anti-fogging effect can be accomplished by the combined use of halogenated anti-fogging compounds described bellow and isocyanate compounds such as described in JP-A 6-208193, aziridine compounds such as described in U.S. Pat. No. 3,017,280 and JP-A 9-5916 or epoxy compounds such as described in JP-A 10-186561 and 9-5916. Further, the combination with carbodiimide compounds described in U.S. Pat. No. 3,100,704 can also exhibit anti-fogging effects next to these.

In the invention, the isocyanate compounds, which can be used in combination with the anti-fogging agent, include the ones represented by the following general formula (I).

General formula (I):

$$O{=}C{=}N{-}L{-}(N{=}C{=}O)_{\nu}$$

where v is 0, 1 or 2 and L is a linkage group, which can be an alkyl, alkenyl, aryl or aralkyl group.

These isocyanate compounds were found to increase stability against fogging. The above aryl group can contain a substituent. The examples of a preferable substituent are selected from a halogen (for example, Br or Cl), hydroxy, amino, carboxy, alkyl and alkoxy.

Examples of specific isocyanate compounds, which are available from manufacturers, are shown bellow, however, the invention is not limited thereby. Following examples include aliphatic, aromatic and polymeric isocyanates.

IC-1: Desmodur N100, product of Movey Co., aliphatic isocyanate

IC-2: Desmodur N3300, product of Movey Co., aliphatic isocyanate

IC-3: Mondur TD-80, product of Movey Co., aromatic isocyanate

IC-4: Mondur M, product of Movey Co., aromatic isocyanate

IC-5: Mondur MRS, product of Movey Co., polymeric isocyanate

IC-6: Desmodur W, product of Movey Co., aliphatic isocyanate

IC-7: Papi 27, product of Dow Chemical Corp., polymeric isocyanate

IC-8: Isocyanate T1890, product of Huels Co., aliphatic isocyanate

IC-9: octadecyl isocyanate, product of Ardrich Co., aliphatic isocyanate

In the invention, a light-insensitive layer may be provided as an outermost layer of the light-sensitive layer side with respect to the support of the light-sensitive material. The thickness of the outermost light-insensitive layer is preferably not less than 0.005 $\mu$m and not more than 0.5 $\mu$m, and more preferably not less than 0.01 $\mu$m and not more than 0.2 $\mu$m, when the water absorption coefficient of the outermost light-insensitive layer is less than 0.7%. The thickness of the outermost light-insensitive layer is preferably not less than 0.02 $\mu$m and not more than 1.2 $\mu$m, and more preferably not less than than 0.05 $\mu$m and not more than 1.0 $\mu$m, when the water absorption coefficient of the outermost light-insensitive layer is not less than 0.7%. Providing the outermost light-insensitive layer described above leads to a thermally developable photothermographic material for making a printing plate having a superior printing life.

In the invention, a printing plate can be prepared by precipitating a water-repellent organic compound, which has been released from organic silver salt grains, in the vicinity of the surface of the photothermographic material, after the thermally developable photothermographic material is exposed and then subjected to thermal development.

In other words, organic silver salt contained in the light-sensitive layer is decomposed in an exposed area into an organic compound and silver metal in the thermally developed light-sensitive material and the organic compound precipitates in the vicinity of the surface. The organic compound is water-repellent (waxy), and a printing plate is formed by utilizing the difference in surface property between the water-repellent portion of image forming area and the hydrophilic portion of the unexposed area. According to the invention, the organic compound can be effectively precipitated in the vicinity of the surface of the photothermographic material.

In the invention, after exposing the thermally developable photothermographic material for making a printing plate followed by subjecting the material to thermal development, it is preferred that the exposed area and the unexposed area of the photothermographic material surface have different contact angles against water.

The contact angle in the invention means the same as a general definition, in which it is the angle θ formed between the water drop and a flat surface when a water drop is placed and rest on the flat surface. The contact angle is measured, for example, by dropping a certain amount of pure water with such as a microcylinder onto a sample horizontally held in an atmosphere of 23° C. and 55% RH and measuring the angle by use of "Contact Angle Meter CA-P" produced by Kyowa-Kagaku Co.

The thermal development of the invention provides a water-repellent portion in exposed area and a hydrophilic portion in the unexposed area, by forming a water-repellent organic compound on the surface of exposed areas as described above; concretely, a printing plate is prepared by utilizing the difference in contact angle for water between the surface of the exposed area and that of the unexposed area; and it is preferred that the contact angle of the surface of the exposed area be larger than that of the unexposed area. The contact angle for water being larger means being directed to being more water-repellent or more hydrophobic. Utilizing the difference of contact angle between the two portions as a printing plate, superior acceptance of a hydrophobic ink in the exposed area, on the contrary, good acceptance of a dampening solution in the unexposed area are achieved to form images. The difference in contact angle between the surface of the exposed area and that of unexposed area is preferably not less than 1°, more preferably not less than 5°, and furthermore preferably not less than 10°. Preferably, the angle is measured by dropping pure water using a dropping pipet onto a horizontally place sample in an atmosphere of 23° C. and 55% RH.

The thermally developable photothermographic material for use in graphic arts according to the invention preferably contains a contrast-increasing agent.

The contrast-increasing agents usable in the invention will be explained below. As preferable examples of contrast-increasing agents used in the invention, substituted alkene derivatives, substituted isooxazole derivatives and specific acetal compounds can be cited, and specifically preferable are compounds represented by the following general formula (1) to (3).

The substituted alkene derivatives represented by the general formula (1), substituted isooxazole derivatives represented by the general formula (2) and specific acetal compounds represented by the general formula (3), which are preferably used in the invention, will be explained as follows.

General formula (1)

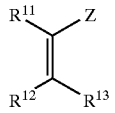

General formula (2)

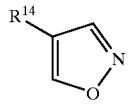

General formula (3)

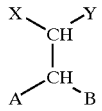

$R^{11}$, $R^{12}$ and $R^{13}$ in the general formula (1) described above each independently represents a hydrogen atom or a substituent, and Z represents an electron attractive group or a silyl group. $R^{11}$ and Z, $R^{12}$ and $R^{13}$, $R^{11}$ and $R^{13}$ or $R^{13}$ and Z in the general formula (1) may bond each other to form a cyclic structure. $R^{14}$ in the general formula (2) represents a substituent. In the general formula (3), X and Y each independently represents a hydrogen atom or a substituent, and A and B each independently represents an alkoxy group, alkylthio group, alkylamino group, aryloxy group, arylthio group, anilino group, heterocyclic oxy group, heterocyclic thio group or heterocyclic amino group. X and Y; or A and B may bond each other to form a cyclic structure.

The contrast-increasing agents represented by the above general formulas (1) to (3) are detailed in JP-A 12-298327 at pp. 18 to 24, and, for example, include exemplary compounds C-1 to C-64 described in pages 21 to 24 of this patent application.

As the contrast-increasing agent of the invention, hydrazine derivatives, also, can be used. Among the hydrazine derivatives, the following hydrazines are preferably used. The hydrazine derivatives preferably used in the invention can be synthesized by the various methods described in the following patents.

Examples thereof include the compounds represented by (Compound-1) described in JP-B 6-77138 (JP-B refers to a published Japanese Patent), and exemplarily, the compounds described at pages 3 and 4 of this patent; the compounds represented by the general formula (I) described in JP-B 6-93082, and exemplarily, the compounds 1 to 38 described at pages 8 to 38 of the patent; the compounds represented by the general formula (4), (5) and (6) described in JP-A 6-230497, and exemplarily, the compounds 4-1 to 4-10 described at pages 25 and 26, the compounds 5-1 to 5-4 described at pages 28 to 36 and the compounds 6-1 to 6-7 described at pages 39 and 40 of the Patent; the compounds represented by the general formula (1) and (2) described in JP-A 6-289520, and exaemplarily, the compounds 1-1) to 1-17) and 2-1) described at pages 5 to 7 of the patent application; the compounds represented by (Compound-2) and (Compound-3) described in JP-A 6-313936, and exemplarily, the compounds described at pages 6 to 19 of the patent application; the compounds represented by (Compound-1) described in JP-A 6-313951, and exemplarily, the compounds described at pages 3 to 5 of the patent application; the compounds represented by the general formula (1) described in JP-A 7-5610, and exemplarily, the compounds I-1 to I-38 described at pages 5 to 10 of the patent application; the compounds represented by the general formula (II) described in JP-A 7-77783, and concretely, the compounds II-1 to II-102 described at pages 10 to 27 of the patent application; the compounds represented by the general formula (H) and (Ha) described in JP-A 7-104426, and exemplarily, the compounds H-1 to H-44 described at pages 8 to 15 of the patent application; the compounds characterized in having an anionic group, or a nonionic group which forms a intra-molecular hydrogen bonding with a hydrogen of the hydrazine, in the neighborhood of the hydrazine group, described in JP-A 9-22082, and specifically represented by the general formula (A), (B), (C), (D), (E) and (F), and concretely, the compounds N-1 to N-30 described in the patent application; and the compounds represented by the general formula (1) described in JP-A 9-22082, and exemplarily, the compounds D-1 to D-55 described in the patent application.

Further, they include various hydrazine derivatives described at pages 25 to 34 of "Conventional Art (pp. 1 to 207)" published by AzTech Co. in March 22nd in 1991; and the compounds D-2 and D-39 described at pages 6 and 7 of JP-A 62-86354.

The hydrazine derivatives preferably used in the invention can be used through solution in a suitable organic solvent, for example, such as alcohols (methanol, ethanol, propanol and fluoroalcohol), dimethyl formamide, dimethyl sulfoxide, and methyl cellosolve.

Further, they can be dissolved by use of an oil such as dibutyl phthalate, tricresyl phosphate, glyceryl triacetate or diethyl phthalate, and a subsidiary solvent such as ethyl acetate or cyclohexane, and by mechanically forming a emulsion dispersion through an emulsion dispersion method well known in the art. They can be used also by dispersing a powdery hydrazine in water by a ball-mill, colloid-mill or ultrasonic wave, which is well known in the art as a solid particle dispersion.

The hydrazine derivatives preferably used in the invention may be added in a layer on the light-sensitive layer side with respect to support of the photothermographic material, that is, may be added in a light-sensitive layer or any light-insensitive layer other than this, and it is preferred to be added in the light-sensitive layer or the light-insensitive layer adjacent thereto.

The addition amount of the hydrazine derivatives preferably used in the invention is preferably $1\times^{-6}$ to $1\times10^{-2}$ mol per 1 mol of silver, more preferably $1\times10^{-5}$ to $5\times10^{-3}$ mol per 1 mol of silver, and most preferably $2\times10^{-5}$ to $5\times10^{-3}$ mol per 1 mol of silver.

In the invention, a contrast-increasing accelerating agent can be used in combination with the contrast-increasing agent above-described to form ultra high contrast images. Examples thereof include such as the amine compounds described in U.S. Pat. No. 5,545,505, and concretely AM-1 to AM-5; the hydroxamic acids described in U.S. Pat. No. 5,545,507, and concretely HA-1 to HA-11; the acrylonitriles described in U.S. Pat. No. 5,545,507, and concretely CN-1 to CN-13; the hydrazines described in U.S. Pat. No. 5,558, 983, and concretely CA-1 to CA-6; and the onium salts described in JP-A 9-297368, and concretely A-1 to A-42, B-1 to B-27 and C-1 to C-14.

Further, the preferable hydrazine derivatives in the invention include the compounds represented by the following general formula (4) to (12):

General formula (4)

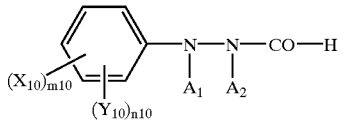

General formula (5)

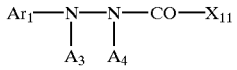

General formula (6)

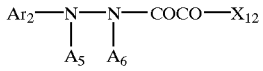

General formula (7)

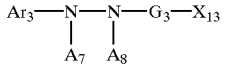

General formula (8)

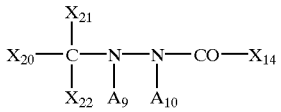

General formula (9)

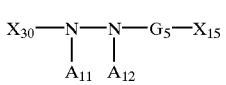

-continued

General formula (10)

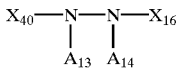

General formula (11)

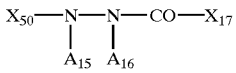

General formula (12)

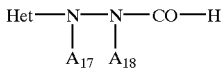

In the general formula (4) above, $Y_{10}$ represents a nitro, methoxy, alkyl or acetamide group, and $X_{10}$ represents a mono-valent substituent, except the substituents represented by $Y_{10}$. m10 is an integer of 0 to 5, n10 is an integer of 0 to 4. $A_1$ and $A_2$ each represents a hydrogen atom, alkylsulfonyl group, arylsulfonyl group or acyl group, and $A_1$ and $A_2$ are both a hydrogen atom, or one of them is a hydrogen atom and the other is an alkylsulfonyl, arylsulfonyl or acyl group. The sum of m10 and n10 is not larger than 5, and when m10 is 0, either of $A_1$ or $A_2$ is an alkylsulfonyl, arylsulfonyl or acyl group.

In the general formula (5), $Ar_1$ represents an aromatic group or heterocyclic group, $A_3$ and $A_4$ each represents the groups of the same definition as those represented by $A_1$ or $A_2$ in the general formula (4). $X_{11}$ represents, an alkyl group substituted by at least one substituent, an aryl group substituted by at least one substituent, an alkenyl, alkynyl, heterocyclic, unsubstituted amino, alkylamino, arylamino, heterocyclic amino, hydrazino, alkoxy or aryloxy group.

In the general formula (6), $Ar_2$ represents an aromatic group or heterocyclic group, $A_5$ and $A_6$ each represents the groups of the same definition as those represented by $A_1$ or $A_2$ in the general formula (4). $X_{12}$ represents a hydrogen atom or a blocking group.

In the general formula (7), $Ar_3$ represents an aromatic group or heterocyclic group, $A_7$ and $A_8$ each represents the groups of the same definition as those represented by $A_1$ or $A_2$ in the general formula (4). $X_{13}$ represents a hydrogen atom or a blocking group, $G_3$ represents —C(═S)—, —$SO_2$—, —SO—, —PO ($X_{33}$)— (where, $X_{33}$ is selected from the same range of groups defined as $X_{13}$, and may be different from $X_{13}$), a vinylene group or an iminomethylene group when G3 is a vinylene group or iminomethlene group. $X_{13}$ is bonded to the α carbon thereof, and $Ar_3$ is a heterocyclic group when G3 is a vinylene group.

In the general formula (8), $X_{20}$, $X_{21}$ and $X_{22}$ each represents a hydrogen atom or a mono-valent substituent, however, $X_{20}$, $X_{21}$ and $X_{22}$ are not simultaneously aromatic groups. $A_9$ and $A_{10}$ each represents the groups of the same definition as those represented by $A_1$ or $A_2$ in the general formula (4), and $X_{14}$ represents a hydrogen atom or a blocking group.

In the general formula (9), $X_{30}$ represents an aliphatic group and $X_{15}$ is a hydrogen atom or a blocking group. $G_5$ represents —COCO— or the groups having the same definition as those represented by $G_3$ in the general formula (7). $A_{11}$ and $A_{12}$ each represents the groups of the same definition as those represented by $A_1$ or $A_2$ in the general formula (4). However, $X_{15}$ is not an unsubstituted anilino group when $G_5$ is —C(═S)—.

In the general formula (10), $X_{40}$ represents an aliphatic group and $X_{16}$ represents an aliphatic group, aromatic group or heterocyclic group. $A_{13}$ and $A_{14}$ each represents the groups of the same definition as those represented by $A_1$ or $A_2$ in the general formula (4). However, $X_{16}$ is no an unsubstituted phenyl group when $X_{40}$ is a trityl group.

In the general formula (11), $X_{50}$ represents a methyl group substituted by three aryl groups and $X_{17}$ represents an unsubstituted amino group, an alkylamino group, a heterocyclic amino group or an alkinyl group. $A_{15}$ and $A_{16}$ each represents the groups of the same definition as those represented by $A_1$ or $A_2$ in the general formula (4).

In the general formula (12), Het represents a heterocyclic group, and $A_{17}$ and $A_{18}$ each represents the groups of the same definition as those represented by $A_1$ or $A_2$ in the general formula (4).

The more detail of the above compounds represented by the general formula (4) to (12) can be referred to pages 4 to 11 of JP-A 10-161270, and the concrete examples of the compounds include the exemplary compounds 1a to 134f at pages 12 to 31 of the patent application.

In the invention, a light-sensitive layer and other light-insensitive layer(s) can generally be coated on a various kind of support. The typical support includes a polyester film, under-coated polyester film, poly(ethylene terephthalate) film, poly(ethylene naphthalate) film, cellulose nitrate film, cellulose ester film, poly(vinylacetal) film, polycarbonate film and related resin materials, glass, metals, etc. These supports may be transparent or opaque. Among these, specifically preferable is biaxially stretched polyethylene terephthalate (PET) having a thickness of approximately 75 to 200 μm.

On the other hand, the dimension of a plastic film generally expands or contracts when it is treated through a heat development apparatus at not lower than 80° C. This retractility is a serious problem in the precision multi-color printing when the material is thermally treated and used for making a printing plate. Therefore, in the invention it is preferable to use a film with a small dimensional change which has been designed to relax the internal strain remaining in the film during the biaxial stretching to minimize the thermal shrinkage strain. For example, is preferably used such as a polyethylene terephthalete heat treated at 100° C. to 210° C. before the coating of the light-sensitive layer. The film having a high glass transition temperature is preferred, and polyether ethylketone, polystylene, polysulfone, polyether sulfone, polyacrylate, polycarbonate, etc. can be used.

Further, as a base material for the support of the printing plate, materials which are commonly known to be used as a base plate can be used. They include, for example, metal plates, plastic films, papers treated with such as polyolefin, the complex base materials in which the above materials are suitably laminated together, etc. Thickness of the base material is not specifically limited as long as being mountable on a press, and of 50 to 500 μm is generally easy to be handled.

As the metal plates, steel, stainless steel and aluminum are cited, and aluminum is specifically preferred in respect to the relationship of specific gravity and rigidity. Aluminum plate is used after degreasing by such as an alkaline, acid or solvent to remove the oil, which has been used in the rolling and winding process, and generally remained on the surface. Degrease treatment is preferably performed by an aqueous alkaline solution. Further, in order to enhance adhesion with a hydrophilic layer, the plate is preferably subjected to an adhesion-enhancing treatment or coating of an under-coating layer on the surface on which a hydrophilic layer is applied. The treatment includes, for example, a method of immersing the plate in a solution containing a coupling agent such as silicate salts and silane coupling agents, or a method of drying the plate sufficiently after coating the solution. An anodic oxidation treatment, which is considered to be a kind of adhesion-enhancing treatments, also can be used. The combination treatment of the anodic oxidation and the aforementioned immersing or coating treatment is also possible. The organic-inorganic sol-gel film according to the method disclosed in JP-A 8-240914 may be formed on the surface having been degreased or anodically oxidized. Further, aluminum plates whose surface is roughened by a method well known in the art can be used.

Next, the thermally developable photothermographic material for making printing plate of the invention will be detailed.

<Organic Silver Salt>

An organic silver salt in the invention is a reducible silver source, and is preferably a silver salt of an organic acid having a carbon atoms of not less than 10 or a heterocyclic organic compound, specifically preferably a long-chained aliphatic carboxylic acid (having carbon atoms of 10 to 30, preferably 15 to 25) and a nitrogen containing heterocyclic compound. Also useful are organic or inorganic complex salts whose ligands are capable of giving a total stability constant against silver ion of 4.0 to 10.0, as described in Research Disclosure (hereinafter, simply denoted as RD) Nos. 17029 and 29963. The preferable examples of these silver salts include are cited below:

Silver salts of organic acids, for example, such as silver salts of gallic acid, oxalic acid, behenic acid, stealic acid, araginic acid, palmitic acid or lauric acid; silver carboxyalkylthioureides, for example, such as silver salts of 1-(3-carboxypropyl)thiourea or 1-(3-carboxypropyl)-3,3-dimethylthiourea; silver salts or complexes of the reaction products of an aldehyde and a hydroxy substituted aromatic carboxlic acid, for example, such as a silver salt or complex of the reaction product of aldehydes (such as formaldehyde, acetaldehyde and butyraldehyde) or hydroxy substituted acids (for example, salicylic acid, benzoic acid and 3,5-dihydroxy benzoic acid); silver salts or complexes of thions, for example, silver salts or complexes of such as 3-(2-carboxyethyl)-4-hydroxymethyl-4-thiazoline-2-thione and 3-carboxymethyl-4-thiazoline-2-thion; complexes or salts of a nitrogen-containing acid selected from imidazole, pyrazol, urazol, 1,2,4-thiazole, 1H-tetrazole, 3-amino-5-benzylthio-1,2,4-triazole or benztriazole, or silver; silver salts of saccharin and 5-chlorosalicylaldoxime; and silver salts of mercaptides. Preferable silver salts among these include silver behenate, silver alginate and silver stearate. Further, in the invention, it is preferred that two or more organic silver salts are mixed in respect of enhancing the developability and forming silver images of high density and high contrast, and it is preferably prepared by mixing a mixture of two or more kinds of organic acid with a silver ion solution.

The organic silver salt is obtained by mixing a water soluble silver salt solution and a compound which forms a complex with silver, and are preferably used for the preparation thereof, methods such as a normal precipitation, reverse-precipitation, double-jet precipitation and controlled double-jet method as described in JP-A 9-127643. For example, an the organic silver salt crystal is prepared, by preparing an organic alkali-metal salt soap (such as sodium behenate and sodium alginate) which is formed by adding an alkali metal salt (such as sodium hydroxide and potassium hydroxide) to an organic acid, followed by adding the aforementioned soap and silver nitrate by the controlled double-jet method. In this case, silver halide grains may concurrently be present in a mixture.

As the organic silver salts according to the invention, various kinds of grains can be used, and preferable are tabular grains. Specifically preferable are tabular organic silver salt grains having an aspect ratio of not less than 3, in addition thereto the average needle ratio, which is observed from the direction perpendicular to the main plane, of not less than 1.1 and smaller than 10.0 in order to pack the grains in a light-sensitive layer with a smaller shape anisotropy of the main planes nearly parallel each other and having the largest areas. The more preferable average needle ratio is not less than 1.1 and smaller than 5.0.

The needle ratio in the invention defined as the value of the longest distance in a grain divided by the shortest distance in a grain. The longest distance represents the maximum value of the straight line connecting any two points in a grain, and the shortest distance represents the minimum distance of two parallel lines which are drawn to circumscribe the grain.

In the invention, "organic silver salt grains comprising the organic silver salt tabular grains having an aspect ratio of not less than 3" means that the organic silver salt grains having an aspect ratio of not less than 3 occupies not less than 50% in the total number of the organic silver salt grains. Further, as the organic silver salt according to the invention, the organic silver salt tabular grains having an aspect ratio of not less than 3 preferably account for not less than 60% of the total number of organic silver grains, more preferably not less than 70% (in number), and specifically preferably not less than 80% (in number).

In the invention, "a grain having an aspect ratio of not less than 3" means a grain having the ratio of equivalent-circle diameter of the grain to the average thickness in the grain, the so-called aspect ratio (abbreviated as AR) represented by the following equation, being not less than 3.

AR=equivalent-circle diameter of the grain ($\mu$m)/average thickness ($\mu$m)

The aspect ratio of the organic silver salt tabular grains according to the invention is preferably 3 to 20, and more preferably 3 to 10. The reason why the aforementioned region is preferred is considered that when the aspect ratio is too low, the organic silver salt grains are apt to be packed closest; while when the aspect ratio is too high, the organic silver grains are apt to overlap each other, and to be dispersed in the coagulated state causing such as light scattering and as a result thereof, lowering of the transparent feeling of the photothermographic material is produced.

Further, to determine the equivalent-circle diameter described above, the organic silver salt having been dispersed is diluted and dispersed on a grid attached with a carbon supporting film, and was pictured by an transmission-type electron-microscope (2000FX, produced by Nihon-Denshi Co.) at a direct magnification of 5000. The negative image was digitized by a scanner, and the diameters (diameters of the equivalent area circles) of not less than 300 grains were measured to calculate the mean grain size. Further, the average grain thickness above described was calculated by the use of TEM (transmission-type electron-microscope).

The method to prepare the organic silver salt grains of the aforementioned shape is not specifically limited, and it is effective, such as to keep the good mixing state at forming the alkali-metal soap of an organic acid and/or adding silver nitrate to the soap, and to optimize the ratio of silver nitrate which reacts with the soap.

Generally, the organic silver salt grains contained in a thermally developable photothermographic material are prepared in an aqueous mother liquor, and, in many cases, mixed therein with the silver halide grains prepared in advance. In the most general preparation process outline, after the above process, slurry and/or wet-cake are obtained by removing the mother liquor by means of such as a centrifugal dehydration. Next, the dried powder was formed through a drying process, being dispersed in an organic solvent and/or a binder to prepare the coating solution, and followed by being coated on a support. Further, the preparation of the organic silver component for thermally developable photothermographic materials well known so far is generally performed in the atmospheric environment.

Further, it is preferred to perform the drying and/or dispersion and/or preparation of coating solution in the preparation process of the organic silver salt under the atmosphere of a low oxygen concentration, because the improvement in the photographic performance of the thermaly developable photothermographic material can be achieved. As a method to obtain the low oxygen concentration, any method such as to evacuate the inside of an apparatus or to replace the inside air by a rare gas such as nitrogen, helium, neon and argon can be applied, and to replace the inside air by nitrogen gas is preferred. Herein, concrete methods can be referred to pages 285 to 286 of "Jikken-Kagaku-Koza, volume No.5".

The drying apparatus applied to the invention is not specifically limited, and any kind of apparatus can be used. The drying apparatus used in the invention includes such as a vacuum drier, freeze-drier, box-drier heated by hot air, pneumatic conveying or spray drier, and a pneumatic conveying drier is specifically preferably used. A pneumatic conveying drier includes such as a straight tube type, a type with an enlarged middle drum for increasing the holding time, a rotating stream type, and a rotating stream type is preferably used in the invention. The air flow speed to operate the pneumatic conveying drier is preferably not less than 2.0 $Nm^3$/min, more preferably not less than 5,0 $Nm^3$/min, and furthermore preferably not less than 8.0 $Nm^3$/min. The hot air temperature is preferably not lower than 20° C., more preferably not lower than 40° C., and furthermore preferably not lower than 60° C.

The organic silver salt grains according to the invention is preferably dispersion-milled by the use of a medium-type homogenizer or a high-pressure homogenizer, after being pre-dispersed, optionally with an addition of a binder, surfactant and the like. For the pre-dispersion described above, a general stirrer such as anchor-type and a propeller-type, a high-speed centrifugal radial-type stirrer (Dissolver) and a high-speed rotating shearing-type stirrer (Homomixer) can be used.

Further, as the medium-type homogenizer described above, rotating mills such as a ball mill, planetary ball mill and vibrating ball mill; medium stirring mills such as a beads mill and an atolighter; and other basket mills can be used, and as the high pressure homogenizers, various types such as one in which a solution being crushed against walls or plugs, a solution being divided into multiple portions to be crushed together at a high-speed, and a solution being passed through a fine orifice can be used.

As the ceramics for the ceramics beads used in the medium dispersion, for example, $Al_2O_3$, $BaTiO_3$, $SrTiO_3$, MgO, ZrO, BeO, $Cr_2O_3$, $SiO_2$, $SiO_2$—$Al_2O_3$, $Cr_2O_3$—MgO, MgO—CaO, Mgo—C, MgO—$Al_2O_3$ (spinel), SiC, $TiO_2$, $K_2O$, $Na_2O$, BaO, PbO, $B_2O_3$, $SrTiO_3$ (strontium titnate), $BeAl_2O_4$, $Y_3Al_5O_{12}$, $ZrO_2$—$Y_2O_3$ (cubic zirconia), 3BeO—$Al_2O_3$—$6SiO_2$ (synthetic emerald), C (synthetic diamond), $Si_2O$—$nH_2O$, silicon nitride, yttrium-stabilized zirconia, zirconia-reinforced alumina, etc. are preferred. Yttrium-stabilized zirconia and zirconia-reinforced alumina (Hereinafter, these ceramics including zirconia are abbreviated as zirconia) are specifically preferred because of the smaller amount of impurities formed by the friction with the beads or the dispersing apparatus.

In the apparatus used for dispersion of the organic silver salt grains according to the invention, the materials of the apparatus parts, being in contact with the organic silver salt grains are preferably composed of ceramics such as zirconia, alumina, silicon nitride and boron nitride or diamond, and zirconia among them is preferably used.

The concentration of a binder to be added, when the dispersion above described is performed, is preferably at 0.1 to 10%, based on the weight of the organic silver, and the temperature of the solution is preferably kept not to over 45° C. throughout the pre-dispersion to the main dispersion processes. As the preferred operating conditions, for example, when a high-pressure homogenizer is used as a dispersing method, the conditions may include a pressure of 29.42 Mpa to 98.06 Mpa and operation cycles of two or more. Further, when a medium-type homogenizer is used as a dispersing method, the preferable operating conditions may include a circumferential speed of 6 m/sec to 13 m/sec.

Further zirconia can be used in the part of beads or equipment parts to be mixed into the dispersed emulsion during the dispersing process. This is preferably effective to enhance the photographic performance. The fragments of zirconia may be after-added into the dispersed emulsion or added previously during the pre-dispersion process. The concrete adding method is not limited, and, for example, the zirconia solution of a high concentration can be obtained by circulating methyl ethyl ketone in a beads mill filled with zirconia beads. The solution is added to the emulsion at a preferable timing with a preferred concentration.

Zirconia of 0.01 to 0.5 mg based on 1 g of silver is preferably contained in the light-sensitive emulsion containing a light-sensitive silver halide and an organic silver salt, and more preferable content of zirconia is 0.01 to 0.3 mg. The preferable incorporation style of zirconia is fine particles of not more than 0.02 $\mu$m.

The conditions of preparing the light-sensitive emulsion comprising a silver halide emulsion and an organic silver salt are not specifically limited, and the conditions such as the followings are included as preferable ones: to keep the good mixing state when the alkali-metal salt soap of an organic acid is formed and/or when the silver nitrate is added to the soap, to optimize the ratio of the silver nitrate reacting with the soap, to use a media homogenizer or a high-pressure homogenizer for the grinding dispersion, to set the binder concentration therein at 0.1 to 10% based on the weight of organic silver, to keep the temperature from drying till the end of main-dispersion not to over 45° C., and to perform stirring at a circumferential speed of not less than 2.0 m/sec using a dissolver for the preparation.

The organic silver salt grains according to the invention is preferably monodisperse, and the preferable monodispersity is 1 to 30%. By using a monodisperse grains of this range, images having a high density can be obtained. Herein, the monodispersity is defined according to the following equation.

Monodispersity=(standard deviation of grain size)/(mean grain size)×100

The mean grain size of the aforementioned organic silver salt is preferably 0.01 to 0.2 $\mu$m, and more preferably 0.02 to 0.15 $\mu$m, wherein the grain size (equivalent-circle diameter) is a diameter of the circle having the same area as each grain image observed in electron-micrography.

The total amount of a silver halide and an organic silver salt is preferably not less than 0.5 and not more than 2.2 g, based on silver per 1 $m^2$ in order to prevent haze of the photothermographic material. In this range, images having a high contrast can be obtained.

<Silver Halide>

The silver halide grains themselves used in the invention can be prepared as a silver halide grain emulsion by the methods described in such as "Chimie et Physique Photographique" by P. Glafkides (published by Paul Montel Co., in 1967), "Photographic Emulsion Chemistry" by G. F. Duffin (published by The Focal Press, in 1964) and "Making and Coating Photographic Emulsion" by V. L. Zelikman et al (published by The Focal Press, in 1964). The method may be any of acidic, neutral or ammoniacal process, and as the reaction form between a soluble silver salt and a soluble halide salt may be any one of a single-jet addition, simultaneous jet addition or the combination thereof, and the so-called controlled double-jet method among them is preferred in which a silver halide is prepared while controlling the precipitation conditions. The halide composition is not specifically limited, and may be any of silver chloride, silver chlorobromide, silver chloroiodobromide, silver bromide, silver iodobromide and silver iodide.

The precipitation of the grains generally divided into two steps, a formation of seed silver halide grains (nucleation) and a growth of the grains, and either of a method in which these steps are continuously performed or a method in which these steps are separately performed can be used. The controlled double-jet precipitation method is preferred because it can control such as the shape and the size of grains by controlling the precipitation conditions such as pAg and pH. For example, in a method in which the nuclei formation and the grain growth are separately performed, silver halide grains are prepared, by firstly forming nuclei (seed grains) by mixing homogeneously and rapidly a soluble silver salt and a soluble halide salt in an aqueous gelatin solution (nucleation process), and then by the grain growth process the grains are grown by supplying a soluble silver salt and a soluble halide salt under the controlled pAg and pH to prepare the silver halide grains. The desired silver halide emulsion can be obtained by removing unnecessary salts and the like by a desalting process well known in the art such as a noodle washing method, flocculation method, ultrafiltration method and electrodialysis method.

The silver halide grains according to the invention preferably have a smaller mean grain size in order to restrain the haze after the image formation to a low level and to obtain superior images, and preferably having a mean grain size of not more than 0.2 $\mu$m, more preferably 0.01 to 0.17 $\mu$m, and specifically preferably 0.02 to 0.14 $\mu$m. The mean grain size, herein, means the edge length of the silver halide grain in the case of so-called regular crystal grains, such as a cubic or octahedral grain. Further, it means the diameter of a circle image having the same area as the projected area of the main surface in the case of other form grains.

The silver halide grains in the invention are preferably monodisperse. Monodisperse herein means that the coefficient of variation of grain size calculated by the following equation is not more than 30%. It is preferably not more than 20%, and more preferably not more than 15%.

Coefficient of variation of grain size (%)=standard deviation of grain size/mean grain size×100

The shape of the silver halide grains includes such as cubic, octahedral, tetradecahedral, tabular, spherical, rod-shaped and potato-shaped, and specifically preferable among them are cubic, octahedral, tetradecahedral and tabular.

When tabular silver halide grains are used, the aspect ratio is preferably not less than 1.5 and not more than 100, and more preferably not less than 2 and not more than 50. These are described in such as U.S. Pat. Nos. 5,264,337, 5,314,798 and 5,320,958, and the aimed tabular grains can be obtained easily. Further, silver halide grains having rounded corners thereof can also preferably be used.

The crystal habit of the silver halide outer surface is not specifically limited, however, when a spectral sensitizer has a crystal habit selective property in the adsorption reaction of a sensitizing dye onto the silver halide grains, it is preferred to use the silver halide grains containing the grain having the crystal habit suitable to the selectivity at a relatively higher proportion. For example, when a spectral sensitizer which adsorbs selectively onto the Miller index [100] surface of a crystal is used, it is preferred that the proportion of [100] surface in the outer crystal surface is high, the ratio is preferably not less than 50%, more preferably not less than 70%, and specifically preferably not less than 80%. The proportion of the Miller index [100] can be determined according to T. Tani, J. Imaging Sci., 29, 165 (1985).

The silver halide grains in the invention is preferably prepared by use of low molecular weight gelatin having a mean molecular weight of not more than 50,000 at the precipitation process, specifically at the nucleation process of silver halide grains.

The low molecular weight gelatin has a mean molecular weight of not more than 50,000, preferably of 2,000 to 40,000, and more preferably of 5,000 to 25,000. The mean molecular weight of gelatin can be measured by means of gel filtration chromatography.

The low molecular weight gelatin can be obtained such as, by an enzyme decomposition in which an enzyme is added to an aqueous solution of a gelatin generally used and having a mean molecular weight of approximately 100000, by an hydrolysis in which the solution is heated with an addition of an acid or alkali, by a decomposition with an ultrasonic irradiation, or by the combination thereof.

The concentration of a dispersing medium at the nucleation is preferably not more than 5% by weight, and it is effective to perform the nucleation at a low concentration of 0.05 to 3.0% by weight.

At the precipitation of the silver halide grains used in the invention is preferably incorporated a compounds represented by the following general formula:

General formula:

$$YO(CH_2CH_2)_m(CH(CH_3)(CH_2O)_p(CH_2CH_2O)_nY$$

where Y represents a hydrogen atom, —$SO_3M$ or —CO—B—COOM, in which M represents a hydrogen atom, an alkali-metal atom, an ammonium group or an ammonium group substituted by an alkyl group having a carbon number of not more than 5 and B represents a chain or cyclic group forming an organic dibasic acid; and m and n each represents 0 to 50; and p represents 1 to 100.

The polyethylene oxide compounds represented by the above general formula have been used as a defoaming agent to restrain remarkedly foaming when the starting materials for the emulsion are transported or stirred in the processes of the preparation of silver halide photographic light-sensitive materials such as a preparation process of an aqueous gelatin solution, an addition process of an aqueous soluble halide and an aqueous soluble silver salt to the gelatin solution, and a coating process of the emulsion on a support, and the technique to utilize them as deforming agents is disclosed such as in JP-A 44-9497. The polyethylene oxide compounds represented by the above general formula also function as a defoaming agent in the nucleation stage.

The compounds represented by the above general formula are preferably used at not more than 1% by weight, and more preferably at 0.01 to 0.10 by weight, based on silver.

The polyethylene oxide compounds represented by the above general formula are preferably present at the nucleation process and are preferably added previously in the dispersion medium before the nucleation, however, they can also be added during the nucleation or in the silver salt solution or in the halide solution which is used for the nucleation. They are preferably used by being added at 0.01 to 2.0% by weight in the aqueous halide solution or in the both aqueous solutions. The compounds are preferably present during a time range of at least not less than 50% of the nucleation process, and more preferably not less than 70%. The compounds represented by the above general formula may be added as powder or by dissolving in a solvent such as methanol.

The temperature in the nucleation process is 5 to 60° C., and preferably 15 to 50° C. The temperature may be a constant, or may follow a temperature rise pattern (for example, a pattern in which the temperature at the start of the nucleation is 25° C., the temperature is gradually raised during the nucleation and the temperature at the end of the nucleation is 40° C.,) or the opposite pattern, however, it is preferably controlled within the aforementioned temperature range.

The concentration of the aqueous silver salt solution or the aqueous halide solution is preferably not more than 3.5 normal, and further preferably used at a low concentration range of 0.01 to 2.5 normal. The addition speed of the silver ion at the nucleation is preferably $1.5\times10^{-3}$ to $3\times10^{-1}$ mol/min, and more preferably $3.0\times10^{-3}$ to $8.0\times10^{-2}$ mol/min with respect to 1 liter of the reaction liquid.

The pH at the nucleation process can be set within a range of 1.7 to 10, and preferably 2 to 6 because the grain size distribution of the nuclei formed is broadened at a pH of an alkaline side. The pBr at the nucleation process is approximately 0.05 to 3.0, preferably 1.0 to 2.5 and more preferably 1.5 to 2.0.

The silver halide grains according to the invention may be added in the light sensitive layer by any method, and are preferably distributed neighboring to the reducible silver source (organic silver salt).

The silver halide grains according to the invention are preferably prepared in advance and added to the solution for preparing the organic silver salt grains, because the preparation processes of the silver halide and the organic silver salt grains can be separately operated which is preferred in respect to the control of the preparation process, however, the silver halide grains can also be formed almost simultaneously with the formation of organic silver salt grains, by allowing a halogen component such as a halide ion to be concurrently present with a organic silver salt forming component, followed by injection of a silver ion thereto, as described in British Patent 1,447,454.

Further, the silver halide grains can be prepared by the conversion of the organic silver salt by acting a halogen containing compound with the organic silver salt. That is, a part of the organic silver salt can be converted to a light-sensitive silver halide by causing a silver halide forming component to act onto a solution or dispersion of an organic silver salt or a sheet material containing an organic silver, which are prepared in advance.

The silver halide forming components include inorganic halogen compounds, onium halides, hydrocarbon halogenides, N-halogen compounds and other halogen containing compounds, and the concrete examples include metal halogenides detailed in U.S. Pat. Nos. 4,009,039, 3,457,075, 4,003,749, British Patent 1,498,956, JP-A 53-27027 and 53-25420; inorganic halogenides such as ammonium haligenides; onium halides such as trimethylphenyl ammoniumbromide, cetylethyldimethyl ammoniumbromide and trimethylbenzyl ammoniumbromide; hydrocarbon halogenides such as iodoform, bromoform, carbon tetrachloride, 2-bromo-2-methyl propane; N-halogen compounds such as N-bromosuccinimide, N-bromophthalimide and N-bromoacetamide; in addition, such as triphenylmethyl chloride, triphenylmethyl bromide, 2-bromoacetate, 2-bromoethanol and dichlorobenzophenone. Thus, the silver halide can be prepared by converting a part or the total of in the organic silver salt to silver halide by the reaction between an organic silver salt and a silver ion. The silver halide grains prepared by the conversion of a part of the organic silver salt can be used in combination with silver halide separately prepared.

These silver halide grains, including those separately prepared and those prepared by conversion of the organic silver salt, are used in an amount of 0.001 to 0.7 mol per 1 mol of the organic silver salt, and preferably 0.03 to 0.5 mol.

The silver halide used in the invention preferably contains an ion of transition metals belonging to 6th to 11th groups of the periodic table. Preferred examples of the metals described above include W, Fe, Co, Ni, Cu, Ru, Rh, Pd, Re, Os, Ir, Pt, and Au. These are used alone or in combination. These metal ions can be incorporated into the silver halide as a metal salt thereof as it is, and also be incorporated as a metal complex or a complex ion thereof. The preferred content is $1\times10^{-9}$ to $1\times10^{-2}$ mol, and more preferred is $1\times10^{-8}$ to $1\times10^{-4}$ mol, based on 1 mol of silver. In the invention, the transition metal complexes or the complex ions are preferably represented by the following general formula:

General Formula: $[ML_6]^m$ where M is a transition metal selected from the elements of 6th to 11th groups of the periodic table, L is a ligand and m is 0, 1−, 2−, 3− or 4−. Concrete examples of ligands represented by L include such as halogen ions (a fluoride ion, chloride ion, bromide ion and iodide ion), cyanide, cyanato, thicyanato, selenosyanato, tellurocyanato, ligands of azido and aquo, nitrocyl, thionitrocil, etc. When an aquo ligand is present, it is preferred to occupy one or two of the ligands. L's can be of the same or different.

Examples of the transition metal complex ions are shown bellow:

1: $[RhCl_6]^{3-}$
2: $[RuCl_6]^{3-}$
3: $[ReCl_6]^{3-}$
4: $[RuCl_6]^{3-}$
5: $[OsCl_6]^{3-}$
6: $[CrCl_6]^{4-}$
7: $[IrCl_6]^{3-}$
8: $[IrCl_6]^{3-}$
9: $[Ru\ (NO)\ Cl_5]^{2-}$
10: $[RuBr_4\ (H_2O)]^{2-}$
11: $[Ru\ (NO)\ (H_2O)\ Cl_4]^{-}$
12: $[RhCl_5\ (H_2O)]^{2-}$
13: $[Re\ (NO)\ Cl_5]^{2-}$
14: $[Re\ (NO)\ (CN)_5]^{2-}$
15: $[Re\ (NO)\ Cl\ (CN)_4]^{2-}$
16: $[Rh\ (NO)_2\ Cl_4]^{-}$
17: $[Rh\ (NO)\ (H_2O)\ Cl_4]^{-}$
18: $[Rh\ (NO)\ (CN)_5]^{2-}$
19: $[Fe\ (CN)_6]^{3-}$
20: $[Rh\ (NS)\ Cl_5]^{2-}$
21: $[Os\ (NO)\ Cl_5]^{2-}$
22: $[Cr\ (NO)\ Cl_5]^{2-}$
23: $[Re\ (NO)\ Cl_5]^{-}$

24: $[Os (NS) Cl_4(TeCN)]^{2-}$
25: $[Ru (NS) Cl_5]^{2-}$
26: $[Re (NS) Cl_{14} (SeCN)]^{2-}$
27: $[Os (NS) Cl (SCN)_4]^{2-}$
28: $[Ir (NO) Cl_5]^{2-}$.

As the compounds of cobalt and iron are preferably used hexacyano metal complexes, and the examples are shown below.

29: $[Fe (CN)_6]^{4-}$
30: $[Fe (CN)_6]^{3-}$
31: $[Co (CN)_6]^{3-}$

The compounds providing these metal ions or complex ions are preferably added during the precipitation of the silver halide grains so as to be included within the silver halide grains. They may be added at any stage of preparation of the silver halide grains, including nucleation, growth, physical ripening or chemical ripening, preferably at the stage of nucleation, growth or physical ripening, furthermore preferably at the stage of nucleation or growth, and most preferably at the stage of nucleation. They may be added in a few times dividing into fractions, and can be incorporated homogeneously within the silver halide grain, or with a distribution in the grain as described such as in JP-A 63-26603, 2-306236, 3-167545, 4-76534, 6-110146 and 5-273683.

These metal compounds can be added through solution in water or suitable organic solvents (for example, alcohols, ethers, glycols, ketones, esters and amides): for example, by a method in which an aqueous solution of the powdered metal compound or that of the metal compound dissolved together with sodium chloride (NaCl) and potassium chloride (KCl) is added in advance into a water soluble silver salt solution or into a water soluble halide solution; by a method in which the metal compounds are added as the third solution when the silver salt solution and halide solution are mixed to prepare silver halide grains through triple-jet precipitation; by a method in which a required amount of an aqueous solution of the metal compounds is added into the reaction vessel during the precipitation of grains; or by a method in which another silver halide grains previously doped with the metal ion or complex ion is added and dissolved during the preparation of the silver halide grains. Specifically preferable is the method in which an aqueous solution of the powdered metal compound or that of the metal compound dissolved together with sodium chloride (NaCl) or potassium chloride (KCl) is added into the water soluble halide solution. When the metal ion is incorporated in the vicinity of the surface of the grain, a required amount of an aqueous solution of metal compounds can also be added into the reaction vessel immediately after completion of precipitation of grains, during or at the finish of physical ripening, or during chemical ripening.

The light-sensitive silver halide grains separately prepared can be desalted by commonly known washing methods, such as noodle washing, flocculation method, etc., however they may also be used without being desalted in the thermally developable photothermographic material of the invention.

Chemical Sensitization

The light-sensitive silver halide grains according to the invention are preferably subjected to a chemical sensitization. Chemical sensitization centers (chemical sensitization nuclei) can be provided by utilizing compounds releasing a calcogen ion such as sulfur or noble metal compounds releasing a gold ion, by the methods described, for example, in Japanese Patent Application Nos. 12-057004 and 12-061942.

In the invention, the chemical sensitization by use of the organic sensitizers containing calcogen atoms shown bellow are preferred.

These organic sensitizing compounds including a calcogen atom preferably contains a group which can adsorb to silver halides and an unstable calcogen atom part.

As these organic sensitizers, can be used those having various structures disclosed in such as JP-A 60-150046, 4-109240 and 11-218874, and it is preferable to use at least one kind of the compounds having a structure in which the calcogen atom is bonded to a carbon atom or a phosphor atom by a double bond.

The using amount of the chalcogen compound as an organic sensitizer varies depending on the chalcogen compound used, the silver halide grains used and the reaction environment to perform a chemical sensitization, however, is preferably $10^{-8}$ to $10^{-2}$ mol based on 1 mol of silver, and more preferably $10^{-7}$ to $10^{-3}$ mol. The environment of the chemical sensitization according to the invention is not specifically limited, however, the chalcogen sensitization is preferably applied in the presence of compounds which can diminish the silver chalcogenide or the silver nuclei on the light-sensitive silver halide grains or can reduce the size thereof, and specifically in the presence of oxidizer which can oxidize the silver nuclei, and as the conditions it is preferred a pAg of 6 to 11 and more preferred 7 to 10, a pH of 4 to 11 is preferred and more preferred 5 to 8, further, a sensitization temperature of not higher than 30° C. is preferred.

Accordingly, in the thermally developable photothermographic material of the invention, it is preferred to use the light-sensitive emulsion, in which the aforementioned light-sensitive silver halide grains are subjected to a chemical sensitization in the coexistence of an oxidizing agent capable of oxidizing the silver nuclei on the grains at a temperature of not higher than 30° C. and are dispersed as an mixture with the organic silver salt, dehydrated and dried.

The chemical sensitization using these organic sensitizers is preferably performed in the presence of spectral sensitizer or hetero-atom containing compounds having adsorptivity onto the silver halide grains. By performing the chemical sensitization under the presence of the compounds having adsorptivity onto the silver halide, the scatteration of chemical sensitization centers can be prevented to achieve high sensitivity and low fog. Although the spectral sensitizer used in the invention will be mentioned later, the hetero-atom containing compounds having an adsorption power onto the silver halide preferably include nitrogen containing heterocyclic compounds described in JP-A 3-24537 as preferable examples. In the nitrogen containing heterocyclic compounds used in the invention, the heterocyclic ring can include such as a pyrazole ring, a pyrimidine ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, and a ring in which two or three of these rings are bonded, for example, such as a triazolotriazole ring, a diazaindene ring, a triazaindene ring and a pentaazaindene ring. The heterocyclic ring in which a single heterocyclic ring and an aromatic ring are condensed, for example, such as a phthalazine ring, a benzimidazole ring, an imidazole ring and a benzthiazole ring are also applicable.

Among these is preferred an azaindene ring, and more preferred are azaindene compounds having a hydroxy group as a substituent, for example, such as hydroxy triazaindene, tetrahydroxy azaindene and hydroxy pentaazaindene.

The heterocyclic ring may contain a substituent other than a hydroxy group. The substituents may include, for example, such as an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom and a cyano group.

The addition amount of these heterocyclic compounds varies in a wide range depending on such as the size and the composition of the silver halide grains or other conditions, however, the approximate amount based on 1 mol of silver is in a range of $10^{-6}$ to 1 mol, and preferably in a range of $10^{-4}$ to $10^{-1}$.

The silver halide grains according to the invention can be subjected to a noble metal sensitization utilizing compounds which releases a noble metal ion such as an gold ion, as described above. For example, such as chloroaurates and organic gold compounds can be used as gold sensitizers.

Further, other than the aforementioned sensitizing methods, a reduction sensitization also can be used, and as the concrete compounds for a reduction sensitization, ascorbic acid, thiourea dioxide, stanous chloride, hydrazine derivatives, borane compounds, silane compounds, polyamine compounds, etc. can be used. The reduction sensitization also can be performed by ripening the emulsion while keeping the pH of the emulsion not lower than 7 or the pAg not higher than 8.3.

The silver halide to be subjected to a chemical sensitization according to the invention may be any of one formed in the presence of the organic silver salt or one formed in the absence of the organic silver salt, or the mixture thereof.

Spectral Sensitization

The light-sensitive silver halide grains in the invention are preferably subjected to a spectral sensitization by adsorbing a spectral sensitizing dye onto the grains. The spectral sensitizing dyes such as cyanine dyes, merocyanine dyes, complex cyanine dyes, complex merocyanine dyes, holopolar cyanine dyes, styryl dyes, hemicyanine dyes, oxonol dyes and hemioxonol dyes can be used. For example, the sensitizing dyes described in JP-A 63-159841, 60-140335, 63-231437, 63-259651, 63-304242, 63-15245, U.S. Pat. Nos. 4,639,414, 4,740,455, 4,741,996, 4,751,175 and 4,835,096 can be used. The useful spectral sensitizing dyes used in the invention are described, for example, in item IV-A of RD No. 17643 (p.23, published in December 1978), item X of RD No. 18431 (p.437, published in August 1978) or the references therein. Specifically, sensitizing dyes having a spectral sensitivity suitable to the spectral characteristics of the light sources of various kinds of laser imagers and scanners are preferably used. For example, the compounds described in JP-A 9-34078, 9-54409 and 9-80679 are preferably used.

For example, for an argon ion laser light source, simple merocyanines described in such as JP-A 60-162247, 2-48635, U.S. Pat. No. 2,161,331, German Patent 936071 and JP-A 5-11389; for a helium-neon laser light source, trinuclear cyanine dyes described in such as JP-A 50-62425, 54-18726 and 59-102229, and merocyanines described in JP-A 7-287338; for a LED and infrared semiconductor laser light sources, thiacarbocyanines described in JP-B 48-42172, 51-9609, 55-39818, JP-A 62-284343 and 2-105135; for an infrared semiconductor laser light source, tricarbocyanines described in JP-A 59-191032 and 60-80841, and dicarbocyanines having 4-quinolin nuclei described in JP-A 59-192242 and the general formula (IIIa) and (IIIb) of JP-A 3-67242 are advantageously selected. Further, in order to correspond such a wavelength range as in case of an infrared laser light source which has wavelengths of not shorter than 750 nm, more preferably of not shorter than 850 nm, sensitizing dyes described in such as JP-A 4-182639, 5-341432, JP-B 6-52387, 3-10931, U.S. Pat. No. 5,441,866 and JP-A 7-13295 are preferably used. These sensitizing dyes may be used independently, and the combination of the sensitizing dyes is often used specifically for the purpose of super-sensitization. A dye having no function of a spectral sensitization itself or a substance having no practical absorption within the visible light region, which exhibit super-sensitization, may be incorporated into the emulsion together with a sensitizing dye.

Mercapto compounds, disulfide compounds and thione compounds can be incorporated, in the invention, to control the development by retarding or accelerating the development, to enhance the spectral sensitization efficiency or to improve the storage stability of the material before or after the development. When a mercapto compound is used in the invention, of any structure can be used, and are preferable mercapto compounds represented by Ar—SM and Ar—S—S—Ar.

In the formula, M is a hydrogen atom or an alkali metal atom, and Ar is an aromatic ring or a condensed aromatic ring containing one or more nitrogen, sulfur, oxygen, selenium or tellurium atoms. The heterocyclic aromatic ring is preferably benzimidazole, naphthimidazole, benzothiazole, naphthothiazole, benzoxathiazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. The heterocyclic aromatic ring may contain the substituent selected from the group constituted of, for example, halogen (such as Br and Cl), hydroxy, amino, carboxy, alkyl (for example, one containing one or more carbon atoms, and preferably 1 to 4 carbon atoms) and alkoxy (for example, one containing one or more carbon atoms, and preferably 1 to 4 carbon atoms). The mercapto substituted heterocyclic aromatic compounds include 2-mercaptobenzoimidazole, 2-mercaptobenzooxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine and 2-mercapto-4-phenyloxazole, however, the invention is not limited thereby.

<Antifogging Agent>

The thermally developable photothermographic material of the invention preferably contains an antifogging agent. The most effective antifogging agent well known is a mercury ion. The use of mercury compounds in light-sensitive materials as an antifogging agent is disclosed, for example, in U.S. Pat. No. 3,589,903. However, the use of mercury compounds is not preferable in respect to environment.

The antifogging agent such as disclosed, for example, in U.S. Pat. Nos. 4,546,075, 4,452,885 and JP-A 59-57234 are preferred as a non-mercury antifogging agent.

The specifically preferable non-mercury antifogging agents are such compounds as disclosed in U.S. Pat. Nos. 3,874,946 and 4,756,999: the hetero cyclic compounds having at least one substituent represented by —C $(X_1)$ $(X_2)$ $(X_3)$ (where, $X_1$ and $X_2$ represents a halogen atom and $X_3$ represents a hydrogen atom or a halogen atom). Further, as other suitable antifogging agents, compounds disclosed in the phrase Nos. [0030] to [0036] of JP-A 9-288328, compounds disclosed in the phrase Nos. [0062] to [0063] of JP-A 9-90550, compounds described in U.S. Pat. No. 5,028,523, European Patent 600,587, 605,981 and 631,176 can be used.

The antifogging agents preferably used in the invention is an organic halogenide, for example, include such compounds as disclosed in JP-A 50-119624, 50-120328, 51-1211332, 54-58022, 56-70543, 56-99335, 59-90842, 61-129642, 62-129845, JP-A 6-208191, 7-5621, 7-2781, 8-15809, 2000-284401, U.S. Pat. Nos. 5,340,712, 5,369,000 and 5,464,737.

Further, since reducing agents having a proton such as bisphenols and sulfonamidephenols are mainly used as described later, compounds which can inactivate the reducing agents by generating an active species which can extract a hydrogen from these compounds are preferably contained. Suitably, preferred compound is a colorless photo-oxidizing substance capable of generating free radicals as a reactive species at the exposure.

Any compounds having these functions can be used, and an organic free radical comprising plural atoms is preferred.

Compounds of any structure can be used, provided that they have such a function and cause no specific harmful effects on silver salt photothermographic dry imaging materials.

These compounds which generate a free radical preferably contains a carbocyclic or a heterocyclic aromatic radical so that the generated free radical has such a stability as showing sufficient contact time to react with and deactivate a reducing agent.

The representative compounds can include biimidazolyl compounds and iodonium compounds.

<Reducing Agent>

The suitable examples of the reducing agents to be included in the thermally developable photothermographic material of the invention are described in U.S. Pat. Nos. 3,770,448, 3,773,512, 3,593,863, Research Disclosure (Hereinafter, also may be abbreviated as RD) 17029 and 29963, and include the followings: aminohydroxycycloalkenone compounds (for example, 2-hydroxypyperidino-2-cyclohexenone), amino reductone esters (forexample, pyperidinohexose reductone monoacetate), N-hydroxyurea derivatives (for example, N-p-methylphenyl-N-hydroxyurea), hydrazones of aldehyde or ketone (for example, anthracenealdehyde phenylhydrazone), phosphoramidephenols, phosphoramideanilines, polyhydroxy benzenes (for example, hydroquinone, t-butyl hydroquinone, isopropyl hydroquinone and (2,5-dihydroxyphenyl)methylsulfone), sulfhydroxamic acids (for example, benzene sulufhydroxamic acid), sulfonamideanilines (for example, 4-(N-methanesulfonamide)aniline), 2-tetrazolylthiohydroquinones (for example, 2-methyl-5-(1-phenyl-5-tetrazolylthio) hydroquinone), tetrahydroquinoxalines (for example, 1,2,3,4-tetrahydro quinoxaline), amideoximes, azines, a combination of aliphatic carboxylic acid arylhydrazides with ascorbic acid, a combination of polyhydroxybenzene and hydroxlyamine, reductone and/or hydrazine, hydroxamic acids, a combination of azines and sulfoneamidephenols, α-cyanophenyl acetate derivatives, a combination of bis-β-naphthol and 1,3-dihydroxybenzene derivatives, 5-pyrazolones, sulfoneamidephenol reducing agent, 2-phenylindane-1,3-dione, chroman, 1,4-dihydropyridines (for example, 2,6-dimethoxy-3,5-dicarboxyethoxy-1,4-dihydropyridine), bisphenols (for example, bis(2-hydroxy-3-t-butyl-5-methylphenyl) methane, 2,2-bis(4-hydroxy-3-methylphenyl) propane and 4,5-etylidene-bis(2-t-butyl-6-methyl) phenol), ultraviolet-sensitive ascorbic acid derivatives and 3-pyrazolidone. Among these, bisphenols are specifically preferable reducing agents. The bisphenols include the compounds represented by the following general formula (A).

General formula (A)

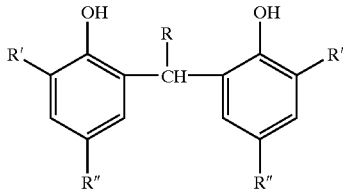

where, R represents a hydrogen atom or an alkyl group having 1 to 10 carbon atoms (for example, isopropyl, butyl and 2,4,4-trimethylpentyl) and R' and R" represents an alkyl group having 1 to 5 carbon atoms (for example, methyl, ethyl and t-butyl).

The concrete example compounds represented by the general formula (A) are shown bellow. However, the invention is not limited by the compounds below.

A-1

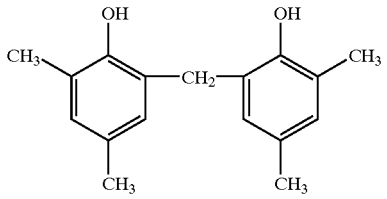

A-2

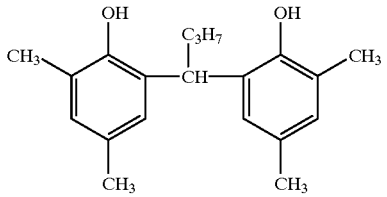

A-3

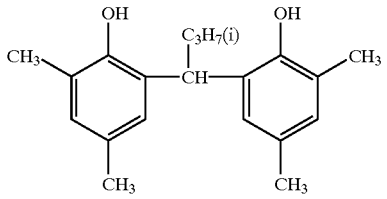

A-4

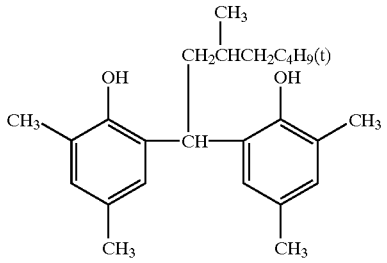

A-5

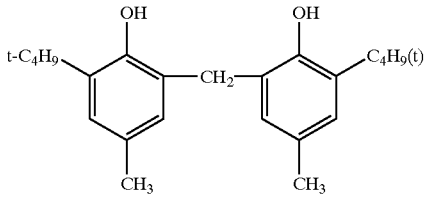

-continued

A-6

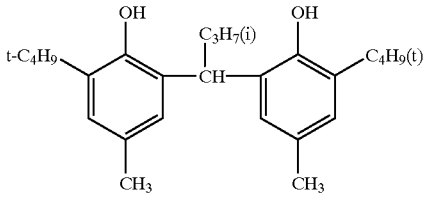

A-7

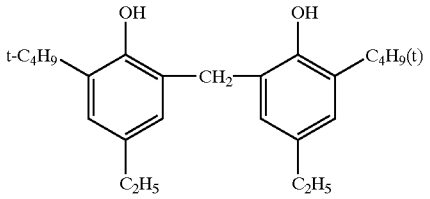

The using amount of the reducing agent, for example, such compounds as represented by the general formula (A) described above, is preferably $1\times10^{-2}$ to 10 mol, and specifically preferably $1\times10^{-2}$ to 1.5 mol, based on 1 mol of silver. The combination use with reducing agents represented by the formula (3) in JP-A 2000-292886 or the formula (A) in JP-A 2000-298327 is more preferable.

<Tone Modifier>

The thermally developable photothermographic material of the invention is preferably incorporated with a tone modifier for the purpose of improving the developed silver image tone. The preferable examples of a tone modifier are disclosed in RD 17029 described above, and include the following:

imides (such as phthalimide), cyclic imides, pyrazoline-5-ones and quinazolines (such as succinimide, 3-phenyl-2-pyrazoline-5-one, 1-phenylurazol, quinazoline and 2,4-thiazolidione), naphthalimides (such as N-hydroxy-1,8-naphthalimide), cobalt complexes (such as cobalt hexamminetrifluoroacetate), mercaptanes (such as 3-mercapto-1,2,4-triazole), N-(aminomethyl) aryl dicarboxyimides (such as N-(dimethylaminomethyl) phthalimide), blocked pyrazoles [such as N.N'-hexamethylene-bis(1-carbamoyl-3,5-dimethylpyrazole)], isothiuronium derivatives and a combination of certain photo-bleaching agents [such as a combination of 1,8-(3,6-dioxaoctane)-bis(isothiuronium trifluoroacetate) and 2-(tribromomethylsulfonyl)-benzothiazole], phthalazinone, phthaladinone derivatives or metal salts thereof [such as 4-(1-naphtyl)phthalazinone, 6-chlorophthalazinone, 5,7-dimethyloxy phthalazinone and 2,3-dihydro-1,4-phthalazinedione], a combination of phthalazinones and sulfinic acid derivatives (such as a combination of 6-chlorophthalazinone and sodium benzenesulfinate or a combination of 8-methylphthalazinone and sodium p-trisulfinate), a combination of phthalazines and phthalic acids, a combination of phthalazines (including the adduct thereof) and at least one compound selected from maleic anhydride, phthalic acids, 2,3-naphthalene dicarboxilic acids, o-phenylenic acid derivatives and anhydrides thereof (such as phthalic acid, 4-methylphthalic acid, 4-nitrophthalic acid and tetrachlorophthalic anhydride), quinazolinediones, benzoxazine, naphthoxazine derivatives, benzoxazine-2,4-diones (for example, 1,3-benzoxazine-2,4-dione), pyrimidines and asymmetric triazines (for example, 2,4-dihydroxypyrimidine) and tetraazapentalene derivatives (for example, 3,6-dimercapto-1,4-diphenyl-1H,4H-2,3a,5,6a-tetraazapentalene). In the invention, the preferable tone modifier is phthalazinone or phthalazine. Further, phthalazine derivatives represented by the general formula (1) described in JP-A 11-218877 are also preferable. The using amount of the tone modifier such as phthalazinone or phthalazine is preferably $1.0\times10^{-3}$ to 10 mol, and more preferably $1\times10^{-2}$ to 5 mol, based on 1 mol of silver, thereby effectuating the invention.

<Matting Agent>

In the invention, in case of a light-insensitive layer(s) is provided on the opposite side of a support to the light-sensitive layer, it is preferred to incorporate a matting agent into at least one layer on the side of the light-insensitive layer(s), and also preferred to incorporate a matting agent on the surface of the light-sensitive material in respect to the control of slipping property and prevention of finger prints. The amount of the matting agent is preferably incorporated at 0.5 to 40% by weight ratio based on the total binder of the layers on the opposite side of the light-sensitive layer.

The material of the matting agent preferably used in the invention may be either of organic or inorganic. Examples of the inorganic material include silica described in Swiss Patent 330,158, glass powder described in French Patent 296,995, and alkaline earth metals or carbonate salts of such as cadmium or zinc described in British Patent 1,173,181. The organic material can include starch described in U.S. Pat. No. 2,322,037, starch derivatives described such as in Belgian Patent 625,451 and British Patent 981,198, polyvinyl alcohol described in JP-B 44-3643, polystyren or polymethacrylate described in Swiss Patent 330158, polyacrylonitril described in U.S. Pat. No. 3,079,257 and polycarbonate described in U.S. Pat. No. 3,022,169.

The shape of the matting agent may be a regular form or irregular form, and preferably a regular and spherical form. The size of a matting agent is expressed by a diameter of a sphere having volume equivalent to that of the matting agent particle (equivalent-sphere diameter). Thus, the size of the matting agent used in the invention refers to the equivalent-sphere diameter.

The mean particle size of the matting agent is preferably 0.5 to 10 $\mu$m, and more preferably 1.0 to 8.0 $\mu$m. A coefficient of variation of particle size distribution is preferably not more than 50%, more preferably not more than 40%, and still more preferably not more than 30%.

The coefficient of variation of particle size distribution, herein, is the value represented by the following equation:

Variation coefficient=(standard deviation of particle size)/(mean particle size)×100

These matting agents may be incorporated in any component layers, however, preferably in the layer other than the light-sensitive layer in order to accomplish the object of the invention, and more preferably in the outermost layer with respect to the support.

The adding method of the matting agent may be one in which the matting agent is dispersed in the coating solution in advance, or one in which the matting agent is sprayed after coating the coating solution and before completion of drying. In case when plurality of the matting agents are added, the both methods may be used in combination.

<Electric Conductive Compounds and Others>

In the thermally developable photothermographic material of the invention, electric conductive compounds such as metal oxides and/or electric conductive polymer compounds can be incorporated in the component layers to improve the static charge buildup. These compounds may be incorporated in any of the component layers, and preferably in such as an under-coating layer, a back-coating layer and a layer between the light-sensitive layer and the under-coating layer.

In the invention, are preferably used electric conductive compounds described in col. 14 to 20 of U.S. Pat. No. 5,244,773.

Various additives used in the thermally developable photothermographic material of the invention may be added in any of the light-sensitive layer, the light-insensitive layer or other component layers. In the invention, may be used such as surfactants, anti-oxidants, stabilizers, plastisizers, UV absorbing agents and coating aids, other than mentioned above. As these additives and aforementioned other additives, the compounds described in RD 17029 above-described can be preferably used.

<Coating Amount of Silver & Coating Method>

The total silver amount in the thermally developable photothermographic material of the invention is preferably 0.1 to 2.4 g/m$^2$, and more preferably 0.5 to 1.2 g/m$^2$. The total silver amount can be determined according to such as the aim and conditions of using the thermally developable photothermographic material, however, thermally developable photothermographic materials which exhibit superior behavior in various performances such as a sensitivity, gradation, fog and storage stability, can be obtained by adjusting the silver amount to the aforementioned range.

All coating solutions used for the preparation of the thermally developable photothermographic material are preferably filtered before the coating. The filtration is preferably performed by allowing the solution to pass at least once through a filter having a absolute filtration accuracy or a semi-absolute filtration accuracy of 5 to 50 $\mu$m.

The coating method of the thermally developable photothermographic material of the invention includes a consecutive multi-layer coating method in which the coating and drying of the various component layers are repeated, and roll coating methods such as reverse roll coating and gravure roll coating, blade coating, wire bar coating, die coating, etc. are used. A method, in which the next layer is coated before the drying of the layer previously coated by the use of plural coaters followed by simultaneous drying of plural layers, and a simultaneous multi-layer coating method, in which plural coating solutions are coated to be accumulated by the use of a slide coater, a curtain-flow coater or an extrusion-type die coater having multiple slits, are also used. Among these, is preferred the latter method in respect to preventing the coating defects caused by foreign matter brought from the outside. Further, when the simultaneous multi-layer coating is applied, it is preferred to set the viscosity at the coating of the coating solution of the uppermost layer is not lower than 0.1 Pa·s and those of the other layers is not lower than 0.03 Pa·s. In addition, the organic solvents contained at the largest portion in the coating solution of each layer are preferably the same kind (in other words, the content of the organic solvent commonly contained in each coating solution is higher than that of the other organic solvents), because the coated layers may get turbulence or haze due to the precipitation of the solid on the boundary surface, when the solid is accumulated with the adjacent layer in liquid phase, provided that the solid, which has been dissolved in the coating solution of each layers, is hard to be dissolved or not to be dissolved in the organic solvent of the adjacent layer.

The drying after the multi-layer coating is preferably performed as early as possible, and it is desirable that the coated layers enter the drying process within 10 sec in order to avoid inter-layer mixing due to the fluidity, diffusion and density difference. As the drying method, such as a hot air drying method and an infrared-ray drying method are used, and specifically preferable is a hot air drying method. The temperature of the hot air is preferably 30 to 100° C.

The thermally developable photothermographic material of the invention may be packed after being cut in the aimed size immediately after being coated and dried, or may be temporarily stocked as a wound roll before being cut and packed. The winding method is not specifically limited, and the tension controlled winding is generally applied.

<Thermal Development Method>

In the preparation method of the printing plate of the invention, the thermal development process may be of any method, however, the development is generally performed by raising the temperature of the image-wise exposed recording material. In the invention, the thermally developable photothermograhic material is heated to not lower than 100° C. to obtain more suitable performances as a printing plate.

In one preferred embodiment of the invention, it is characterized in that the thermally developable photothermographic material for graphic arts, after being passed through the heating zone of the temperature of not lower than 100° C., is subjected to the thermal development without bringing the surface of the light-sensitive layer side into contact with so-called transporting rolls until reaching the heating zone of the temperature of 90° C., and by this method of the thermal development more enhanced properties as a printing plate is obtained. Concretely, a horizontal transportation method is preferred, and the method to transport by bringing the opposite side surface to that of holding the light-sensitive layer into contact with the transporting rollers is preferred. The preferable developing temperature is 100 to 250° C. and more preferable is 100 to 150° C. The developing time is preferably 1 to 180 sec. and more preferably 10 to 90 sec. Further, a method in which after pre-heating at a temperature of not lower than 80° C. and lower than 100° C. for 5 sec. not to turn up the images, a printing plate is prepared by a thermal development at not lower than 100° C. and not higher than 150° C. is effective to prevent the non-uniformity of the processing.

EXAMPLES

The present invention will be detailed by the examples, however, embodiments of the invention are not limited to these.

Example 1

The thermally developable photothermographic material was prepared according to the following method.

[Preparation of Polyethylene Terephthalate (Abbreviated as PET) Support]

PET pellets were dried at 130° C. for 4 hrs., extruded through T-type die coater after being fused at 300 and rapidly cooled to prepare non-stretched PET film. This film was longitudinally stretched by 3 times by the use of rolls with different circumferential speeds and then subjected to a lateral stretching of 4.5 times by the use of a tenter. The temperatures thereat are 110° C. and 130° C., respectively. Thereafter, the film was laterally relaxed by 4% after being fixed at 240° C. for 20 sec. Then, the film was subjected to knurling on the both sides after the zipped parts by the tenter being slitted out, followed by being wound up at $3.92\times10^5$ Pa. Thus, the PET film of 2.4 m wide, 800 m long and 125 $\mu$m thick, in roll-formed, was obtained.

<Under-Coating Treatment>

The PET film support prepared above, which has been biaxially stretched and thermally fixed and of 125 $\mu$m thick, after being subjected a corona discharge treatment of 8 W/m$^2$·min on its both sides, was coated with the under-coating layer coating solution a-1 described below on the one surface of the support so as to make the dried film thickness 0.8 μm and dried to obtain the under coating layer A-1, and, further, was coated with the under-coating layer coating solution b-1 for an antistatic treatment described below on the oposite surface of the support so as to make the dried film thickness 0.8 μm and dried to obtain the antistatic under coating layer B-1.

| Under-coating layer coating solution a-1 | |
|---|---|
| Copolymer latex solution (30% solid content) of butylacrylate (30 weight %) , t-butylacrylate (20 weight %), styrene (25 weight %) and 2-hydroxyethylacrylate (25 weight %) | 270 g |
| (C-1) | 0.6 g |
| Hexamethylene-1,6-bis(ethyleneurea) | 0.8 g |
| Polystyrene fine particles (mean particle size: 3 μm) | 0.05 g |
| Colloidal silica (mean particle size: 90 μm) | 0.1 g |
| Water to make 1 L | |
| **Under-coating layer coating solution b-1** | |
| SnO2/Sb (weight ratio: 9/1, mean particle size: 0.18 μm) | an amount to make 200 mg/m$^2$ |
| Copolymer latex solution (30% solid content) of butylacrylate (30 weight %), styrene (20 weight %) and glycidylacrylate (40 weight %) | 270 g |
| (C-1) | 0.6 g |
| Hexamethylene-1,6-bis(ethyleneurea) | 0.8 g |
| Water to make 1 L | |

Successively, a corona discharge treatment of 8 W/m$^2$·min was applied on the surfaces of the under-coating layers A-1 and B-1, the upper under-coating layer coating solution a-2 was coated on the surface of A-1 so as to make the dried film thickness 0.1 μm to form an upper under-coating layer A-2, and the upper under-coating layer coating solution b-2 was coated on the surface of B-1 so as to make the dried film thickness 0.8 μm to form an upper under-coating layer B-2.

| Upper under-coating layer coating solution a-2 | |
|---|---|
| Gelatin | a weight to make 0.4 g/m$^2$ |
| (C-1) | 0.2 g |
| (C-2) | 0.2 g |
| (C-3) | 0.1 g |
| Silica fine particles (mean particle size: 3 μm) | 0.1 g |
| Water to make 1 L | |
| **Upper under-coating layer coating solution b-2** | |
| (C-4) | 60 g |
| Latex solution composed of (C-5) (solid content: 20%) | 80 g |
| Ammonium sulfate | 0.5 g |
| (C-6) | 12 g |
| Polyethylene glycol (weight average molecular weight: 600) | 6 g |
| Water to make 1 L | |

(C-1)

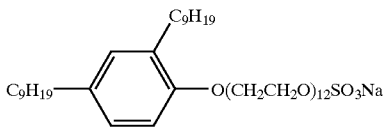

-continued (C-2)

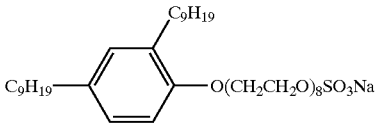

(C-3)

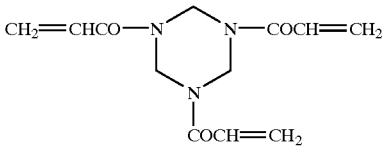

(C-4)

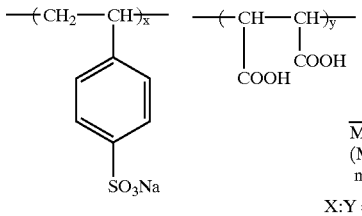

$\overline{Mn}$ = 5000
(Mn is number average molecular weight)

X:Y = 75:25 (weight ratio)

(C-5)

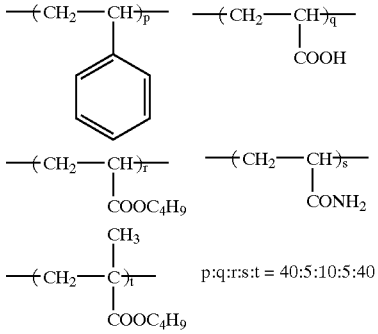

p:q:r:s:t = 40:5:10:5:40 (weight ratio)

(C-6)

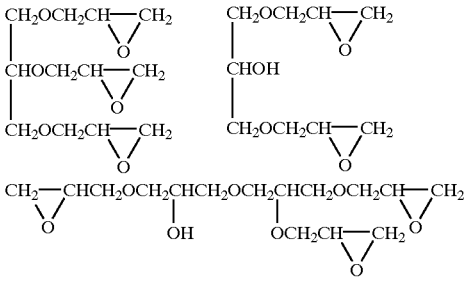

mixture of 3 kinds

<Thermal Treatment of Support>

In the under-coating drying process of the under-coated support described above, the support was heated at 140° C., and then was gradually cooled. This support was wound up at a tension of 2.94×10$^5$ Pa.

[Preparation of Light-Sensitive Emulsion]

Preparation of Silver Halide Emulsion

After 7.5 g of an inert gelatin and 10 mg of potassium bromide were dissolved in 900 ml of water and further after adjusting the temperature at 35° C. and the pH at 3.0, 370 ml of an aqueous solution containing 74 g of silver nitrate; and 370 ml of an aqueous solution containing, sodium chloride, potassium bromide, and potassium iodide in a mol ratio of 60/38/2, and $1\times10^{-6}$ mol, based on 1 mol of silver, of [Ir (NO) $Cl_5$] salt and $1\times10^{-6}$ mol, based on 1 mol of silver, of rhodium chloride; were added thereto by means of a controlled double-jet method keeping the pAg at 7.7. Then, 4-hydroxy-6-methyl-1,3,3a,7-tetrazaindene was added, and the reduction sensitization was performed by adjusting the pH to 8 and the pAg to 6.5 to obtain a cubic silver iodobromide grains having a mean grain size of 0.06 μm, a monodispersity of 10%, a coefficient of variation of the projected area diameter of 8% and a [100] plane proportion of 87%. This emulsion, after being desalted by flocculation with an addition of a gelatin flocculent, was added with 0.1 g of phenoxyethanol, and the pH and the pAg were adjusted to 5.9 and 7.5 respectively to obtain the silver halide emulsion.

Preparation of Sodium Behenate Solution

Behenic acid of 32.4 g, 9.9 g of alginic acid and 5.6 g of stearic acid were dissolved in 945 ml of pure water at 90° C. Next, 98 ml of 1.5 mol/L sodium hydroxide solution was added thereto with high speed stirring. Then, 0.93 ml of concentrated nitric acid was added thereto, cooled to 55° C. and stirred for 30 min. to obtain the sodium behenate solution.

Preparation of Preformed Emulsion Comprising Silver Behenate and Silver Halide Emulsion To the sodium behenate solution described above was added 1.51 g of the aforementioned silver halide emulsion, after the pH being adjusted to 8.1 by a sodium hydroxide solution, 147 ml of 1 mol/L silver nitrate solution was added thereto in 7 min., and after further being stirred for 20 min., aqueous soluble salts were removed by means of an ultrafiltration to prepare the silver behenate. The prepared silver behenate were grains having a mean grain size of 0.8 μm and a monodispersity of 8%. After forming the flock of the dispersion the water was removed, further 6 times of washing and dehydration were repeated, and the emulsion was dried by the use of a flash-jet drying apparatus.

Preparation of Preliminary Dispersion Solution A

Powdered polyvinyl butyral of 14.57 g (Butvar B-79, produced by Monsanto Co., Ltd.) was dissolved in 1457 g of methyl ethyl ketone (hereinafter, abbreviated as MEK), 500 g of the powdered organic silver salt A was gradually added with stirring by a dissolver "DISPERMAT CA-40M" (produced by VMA-GETZMANN Co.), and the solution was mixed throughly to obtain the preliminary dispersion solution A.

Preparation of Light-Sensitive Emulsion Dispersion Solution-1

The preliminary dispersion solution A was supplied to a media-type dispersor "DISPERMAT SL—C12EX (produced by VM-GETZMANN Co.), 80% of the capacity thereof being filled with zirconia beads having a diameter of 0.5 mm (TORAYCERAM, produced by TORAY Corp.), by the use of a pump so as to make the standing time in the dispersing mill 1.5 min., and dispersion was performed with a circumferential mill speed of 13 m/sec to prepare the light-sensitive emulsion dispersion solution-1.

Preparation of Stabilizer Solution

Stabilizer-a of 1.0 g and 0.13 g of potassium acetate were dissolved in 4.97 g of methanol to prepare the stabilizer solution.

Stabilizer-a

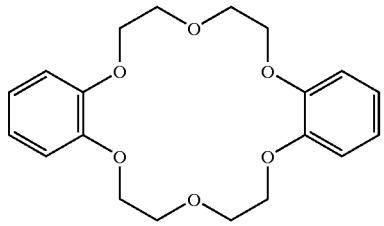

Preparation of Infrared Sensitizing Dye Solution

Infrared sensitizing dye-1 of 19.2 mg, 1.488 g of 2-chloro benzoic acid, 2.779 g of stabilizer solution and 365 mg of 5-metyl-2-mercaptobenzimidazole were dissolved in 31.3 ml of MEK in the dark to prepare the infrared sensitizing dye solution.

Infrared sensitizing dye-1

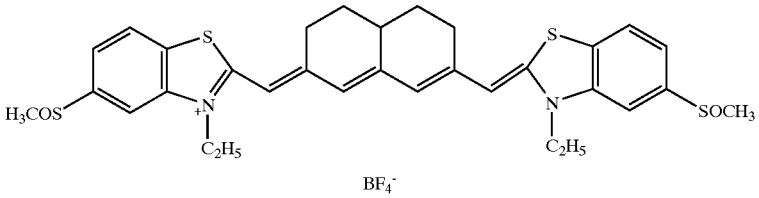

Preparation of Additive Solution-a 1,1-bis(2-hydroxy-3,5-dimethylphenyl)-2-methylpropane of 27.98 g as a reducing agent, 1.54 g of methyl phthalate and 0.48 g of Infrared sensitizing dye-1 were dissolved in 110 g of MEK to prepare additive solution-a.

Preparation of Additive Solution-b

Anti-fogging agent (compound-c) of 3.56 g and 3.43 g of phthalazine were dissolved in 40.9 g of MEK to prepare additive solution-b.

Preparation of Additive Solution-c

Contrast increasing agent-1 of 5 g was dissolved in 45.0 g of MEK to prepare additive solution-c.

Preparation of Light-Sensitive Layer Coating Solution

Under the atmosphere of an inert gas (97% of nitrogen), 50 g of the light-sensitive emulsion dispersion solution described above and 15.11 g of MEK were kept at a temperature of 21° C. with stirring, 390 μl of compound-d (10% methanol solution) was added thereto, and the solution was stirred for 1 hr. Further, after adding 494 μl of calcium bromide (10% methanol solution) and stirring for 10 min., 1.32 g of the infrared sensitizing dye solution described above was added and the solution was stirred for 1 hr. Then the temperature was lowered to 13° C., and while keeping the solution at 13° C., after adding 13.31 g of polyvinyl chloride and stirring for 30 min., 1.084 g of tetrachloro phthalic acid (9.4 weight % MEK solution) was added and the solution was stirred for 15 min. While keeping the stirring, 12.43 g of additive solution-a, 1.6 ml of "Desmodur N3300" (10% MEK solution of fatty acid isocyanate, produced by Movey Co.), 4.27 g of additive solution-b and 20.0 g of additive solution-c were added in this order, and the solution was stirred to prepare the light-sensitive layer coating solution.

Compound-c

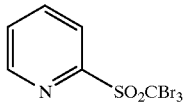

Contrast increasing agent-1

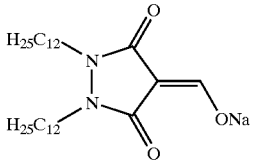

Compound-d

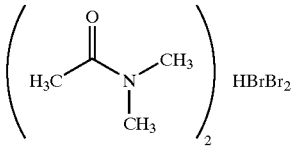

Infrared dye-1

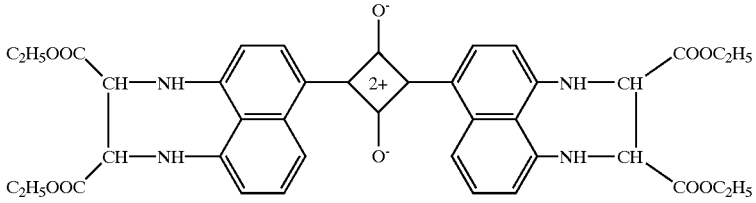

Preparation of Coating Solutions for Back Surface

| Preparation of lower back-coating layer coating solution | |
|---|---|
| Cellulose acetate butylate (10% MEK solution) | 5 ml/m$^2$ |
| Cellulose acetate propylate (10% MEK solution) | 15 ml/m$^2$ |
| Dye-A an amount to make the absorbance 0.9 at 780 nm | |
| **Preparation of upper back-coating layer coating solution** | |
| Cellulose acetate butylate (10% MEK solution) | 15 ml/m$^2$ |
| $C_8F_{17}O(CH_2CH_2O)_{22}C_8F_{17}$ | 50 mg/m$^2$ |
| $C_8F_{17}SO_3Li$ | 10 mg/m$^2$ |
| Antistatic agent(*) | 30 mg/m$^2$ |

(*)Antistatic agent: $(CH_3)_3SiO—[(CH_3)_2SiO]_{20}—[CH_3SiO\{CH_2CH_2CH_2O(CH_2CH_2O)_{10}(CH_2CH_2CH_2O)_{15}CH_3\}]_{30}—Si(CH_3)_3$ Dye-A

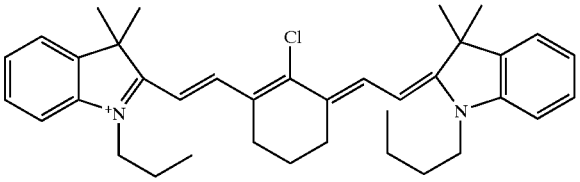

Preparation of Sample 1

The above-described lower back-coating layer coating solution and upper back-coating layer coating solution, after being filtered through the filter having a semi-absolute filtering accuracy of 20 μm, were accumulatively coated by being extruded through the slit of an extrusion-type die coater on B-2 layer of the support prepared above, 8 sec. thereafter, the coated support was dried with a hot air at a dry-bulb temperature of 75° C. and a dew point of 10° C. for 5 min., then, the light-sensitive layer coating solution prepared above whose viscosity was made to 0.228 Pa·s by adjusting the amount of the solvent, after being filtered through the filter having a semi-absolute filtering accuracy of 20 μm, was coated by being extruded through the slit of an extrusion-type die coater on A-2 layer of the support so as to make the silver amount 1.5 g/m$^2$, 8 sec. thereafter was dried with a hot air at a dry-bulb temperature of 75° C. and a dew point of 10° C. for 5 min., and was wound up in a roll shape in the atmosphere of 23° C. and 50% RH, with a tension of 196 N/m (20 kg/m) to prepare the thermally developable photothermographic material Sample 1.

Preparation of Samples 2 to 6

Sample 2: Sample 2 was prepared in a similar manner to Sample 1 above prepared, except that the additive solution-c in the light-sensitive layer coating solution was eliminated.

Sample 3: Sample 3 was prepared in a similar manner to Sample 2 above prepared, except that polyvinyl chloride in the light-sensitive layer coating solution was changed to polyvinyl butyral (Butvar B-79 produced by Monsanto Co.).

Sample 4: Sample 4 was prepared in a similar manner to Sample 1 above prepared, except that polyvinyl chloride in the light-sensitive layer coating solution was changed to polyvinyl butyral (Butvar B-79 produced by Monsanto Co.).

Sample 5: Sample 5 was prepared in a similar manner to Sample 2 above prepared, except that polyvinyl chloride in the light-sensitive layer coating solution was changed to polyvinyl acetal.

Sample 6: Sample 6 was prepared in a similar manner to Sample 1 above prepared, except that polyvinyl chloride in the light-sensitive layer coating solution was changed to polyvinyl acetal.

Exposure:

The Samples 1 to 6 prepared above were exposed by a image setter, ECRM Mako 3600, equipped with an infrared LD having a wavelength of 780 nm. The exposure was performed at the right output power that gave a measured value of 60% screen dot corresponding to the theoretical output value of 50% screen dot with a 175-line screen.

[Thermal Development]

A vertical sectional view of a thermal development apparatus used in the invention is shown in FIG. 1. In the thermal developing section 1 in FIG. 1, transporting rolls 2 are arranged, opposing heating rolls 3 which include a halogen lamp heater and is covered with silicone rubber on the surface. The transporting roll 2 is made of aluminum center metal having an outer diameter of 50 mm and a thickness of 4 mm covered with silicone rubber having a thickness of 4 mm. The thermal development was performed by adjusting the process conditions as to make the temperatures of the rolls, from the left bottom one of FIG. 1 in order, 70, 80, 80, 90, 90, 95° C. by the heating roll; the panel heaters 4, from the left one, 120, 125, 120° C.; and the right end roll 75° C. The line speed was 30 m/sec, the processing time of the roll heating portion was 15 sec., and that of the panel heating portion 15 sec to make the total processing time 35 sec.

Further, the thermal development condition-1 described in Table 1, which will be mentioned later, means that processing was performed by the state in which a to f of the transporting rolls 2 are detached, the thermal development condition-2 means that the processing was performed by the state in which a to f of the transporting rolls 2 are mounted, and the processing were respectively performed according to the conditions described in Table 1.

[Preparation of Printed Matter]

Lithographic printing was performed with each of thermally developed samples prepared above using Hidel GTO, coated paper, a dampening solution (H solution SG-51 produced by Tokyo Ink Co., concentration of 1.5%) and ink (Hiplus, produced by Toyo Ink Co.).

[Evaluation of Each Characteristic]

The evaluation of various characteristics were performed according to the following methods.

Measurement of Water Absorption

The light-sensitive layer coating solution was coated on the flat table with Teflon treatment so as to make the dry film thickness 3.18 mm, and after being dried, the film sample was peeled off from the Teflon table. The sample was cut into the size of 5 cm by 5 cm, and, after the solvent being vaporized by keeping the sample in a thermostat of 55° C. for 5 hrs., were immersed in pure water of 23° C. for 24 hrs. Thereafter, the water drops on the both surfaces of sample were absorbed by Kim-towel to measure the weight (S). Then, after the sample was kept in a thermostat of 55° C. for 5 hrs, the weight (D) was measured to calculate the water absorption according to the following equation.

Water absorption=(S−D)/D×100 (%)

Evaluation of Printing Life

The printing was continued until bad ink acceptance emerged in the image area of each of the printed matter prepared, and the number of printed sheets at that time was considered as a measure of printing life. Mark "-" in Table-1 indicates that the value was not noted because a normal image was not able to be formed from the beginning and the printed image was not worth to be evaluated at all with 300 sheets of print. In the invention, print of 300 sheets was considered as a lower allowable limit of the practical printing life.

Evaluation of Smudge in Non-Image Area

The degree of smudge in the non-image area at 300 sheets of continuous printing was evaluated visually into ten ranks based on the criteria shown bellow.

Rank 10: no smudge was visually observed

Rank 7: slight smudge spots were observed with a careful search

Rank 5: smudge spots were easily observed

Rank 1: countless number of smudge spots were observed in all over the non-image area The other ranks in the Table means the intermediate characteristics of each rank. The ranks 5 or more in the above criteria were judged to have no problems in practical use.

Evaluation of Opening of Shadow Screen Dots

The degree of opening of screen dots in a shadow portion (175 line screen dot of 70% in image area) at the time of 300 sheets continuous print was evaluated visually into ten ranks, based on the criteria shown below.

Rank 10: no closing

Rank 7: minimal closing was observed

Rank 5: closing was easily observed

Rank 1: closing was observed in almost all over the portion

The other ranks in the Table means the intermediate performance of each rank. The ranks 5 or more in the above criteria were judged to have no problems in practical use.

Evaluation of Recovery from Smudge

After continuous 300 sheets print the supply of the dampening solution was stopped, then, after only ink having been put on the whole surface of the printing plate, the dampening water was started to be supplied again to start printing. The recovery performance from smudge was evaluated by the number of sheets printed when the degree of the smudge came to the same level as that of when 300 sheets were printed. The smaller the number of sheets printed, the better, and 60 sheets were considered an upper allowed limit in practical use.

The results according to the above evaluation are shown in Table 1.

TABLE 1

| | | Light-sensitive layer | | Contrast | Thermal | Printing | Smudge in | Openning | Recovery | |
|---|---|---|---|---|---|---|---|---|---|---|
| Test No. | Sample No. | Main binder | Water absop. (%) | increasing agent | dev. Condition | Life (sheets) | non-image area | of shadow screen | from smudge (sheets) | Re-marks |
| 1-1 | 2 | Polyvinyl chloride | 0.4 | — | 1 | — | 1 | 1 | Not less than 100 | Comp. |
| 1-2 | 1 | Polyvinyl chloride | 0.4 | 1 | 1 | — | 1 | 1 | Not less than 100 | Comp. |

TABLE 1-continued

| Test No. | Sample No. | Light-sensitive layer: Main binder | Light-sensitive layer: Water absop. (%) | Contrast increasing agent | Thermal dev. Condition | Printing Life (sheets) | Smudge in non-image area | Openning of shadow screen | Recovery from smudge (sheets) | Remarks |
|---|---|---|---|---|---|---|---|---|---|---|
| 1-3 | 1 | Polyvinyl chloride | 0.4 | 1 | 2 | — | 1 | 1 | Not less than 100 | Comp. |
| 1-4 | 3 | Polyvinyl butyral | 2.0 | — | 1 | 700 | 5 | 5 | 60 | Inv. |
| 1-5 | 4 | Polyvinyl butyral | 2.0 | 1 | 1 | 700 | 6 | 6 | 60 | Inv. |
| 1-6 | 4 | Polyvinyl butyral | 2.0 | 1 | 2 | 500 | 6 | 6 | 60 | Inv. |
| 1-7 | 5 | Polyvinyl acetal | 8.0 | — | 1 | 700 | 5 | 5 | 60 | Inv. |
| 1-8 | 6 | Polyvinyl acetal | 8.0 | 1 | 1 | 700 | 6 | 6 | 60 | Inv. |
| 1-9 | 6 | Polyvinyl acetal | 8.0 | 1 | 2 | 500 | 5 | 6 | 60 | Inv. |

As can be seen from Table 1, the samples comprising the composition according to the invention, compared to the comparative samples, were confirmed to be superior in printing life, smudge in non-image area, opening of shadow screen dots and recovery from smudge performance. In Sample 4, the observation of the surfaces of image area and of non-image area after the thermal development through an electron microscope in addition to the analysis of the surface composition proved that behenic acid and stearic acid were rich in the exposed area than in the unexposed area.

Example 2

Preparation of Samples 7 to 14

Sample 7: Sample 7 was prepared in a similar manner to Sample 3 prepared in Example 1, except that the following light-insensitive layer coating solution-1 was coated on the light-sensitive layer to form a light-insensitive layer.

Light-Insensitive Layer Coating Solution-1

| | |
|---|---|
| Polyvinyl chloride | 1.3 μm |
| an amount to make a dry thickness of the light-insensitive layer | |
| Methyl ethyl ketone | 30 mg/m$^2$ |
| $C_8F_{17}O(CH_2CH_2O)_{22}C_8F_{17}$ | 50 mg/m$^2$ |
| $C_8F_{17}SO_3Li$ | 10 mg/m$^2$ |

Sample 8: Sample 8 was prepared in a similar manner to Sample 7 described above, except that 5 g of a contrast increasing agent-2 was added to the MEK solution of the additive solution-c for the light-sensitive layer.

Sample 9: Sample 9 was prepared in a similar manner to Sample 2 prepared in Example 1, except that the following light-insensitive layer coating solution-2 was coated on the light-sensitive layer to form a light-insensitive layer.

Light-Insensitive Layer Coating Solution-2

| | |
|---|---|
| Polyvinyl butyral | 1.3 μm |
| an amount to make a dry thickness of the light-insensitive layer | |
| Methyl ethyl ketone | 30 mg/m$^2$ |
| $C_8F_{17}O(CH_2CH_2O)_{22}C_8F_{17}$ | 50 mg/m$^2$ |
| $C_8F_{17}SO_3Li$ | 10 mg/m$^2$ |

Sample 10: Sample 10 was prepared in a similar manner to Sample 9 described above, except that 5 g of a contrast increasing agent-2 was added to the MEK solution of the additive solution-c for the light-sensitive layer.

Sample 11: Sample 11 was prepared in a similar manner to Sample 3 prepared in Example 1, except that the following light-insensitive layer coating solution-3 was coated on the light-sensitive layer to form a light-insensitive layer.

Light-Insensitive Layer Coating Solution-3

| | |
|---|---|
| Cellulose nitrate | 1.3 μm |
| an amount to make a dry thickness of the light-insensitive layer | |
| Methyl ethyl ketone | 30 mg/m$^2$ |
| $C_8F_{17}O(CH_2CH_2O)_{22}C_8F_{17}$ | 50 mg/m$^2$ |
| $C_8F_{17}SO_3Li$ | 10 mg/m$^2$ |

Sample 12: Sample 12 was prepared in a similar manner to Sample 11 described above, except that 5 g of a contrast increasing agent-2 was added to the MEK solution of the additive solution-c for the light-sensitive layer.

Sample 13: Sample 13 was prepared in a similar manner to Sample 3 prepared in Example 1, except that the following light-insensitive layer coating solution-4 was coated on the light-sensitive layer to form a light-insensitive layer.

Light-Insensitive Layer Coating Solution-4

| | |
|---|---|
| Ethyl cellulose | 1.3 $\mu$m |
| an amount to make the dry thickness of a light-insensitive layer | |
| Methyl ethyl ketone | 30 mg/m$^2$ |
| $C_8F_{17}O(CH_2CH_2O)_{22}C_8F_{17}$ | 50 mg/m$^2$ |
| $C_8F_{17}SO_3Li$ | 10 mg/m$^2$ |

Sample 14: Sample 14 was prepared in a similar manner to Sample 13 described above, except that 5 g of a contrast increasing agent-2 was added to the MEK solution of the additive solution-c for the light-sensitive layer.

Contrast increasing agent-2

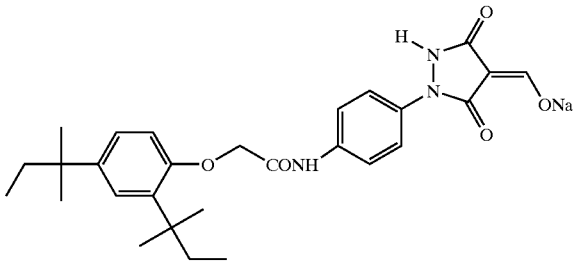

Evaluation of Respective Characteristics

Measurement of Water Absorption

In respect to each light-sensitive and light-insensitive layers used for the preparation of each sample above mentioned, the water absorption of the light-sensitive and light insensitive layers were measured in a similar manner to Example 1.

Evaluation of Printing Life, Smudge in Non-Image Area, Opening of Shadow Screen Dots and Recovery from Smudge The evaluations were performed according to the methods described in Example 1. The thermal development processing method of each sample was followed to the conditions described in Table 2.

The results obtained according to the above evaluations are shown in Table 2.

TABLE 2

| | | Light-sensitive layer | | Non-light-sensitive layer | | Cont. | Thermal |
|---|---|---|---|---|---|---|---|
| Test No. | Sample No. | Main binder | Water absop. (%) | Main binder | Water absop. (%) | increasing agent | dev. cond. |
| 2-1 | 7 | Polyvinyl butyral | 2.0 | Polyvinyl chloride | 0.4 | — | 1 |
| 2-2 | 8 | Polyvinyl butyral | 2.0 | Polyvinyl chloride | 0.4 | 2 | 1 |
| 2-3 | 8 | Polyvinyl butyral | 2.0 | Polyvinyl chloride | 0.4 | 2 | 2 |
| 2-4 | 9 | Polyvinyl butyral | 0.4 | Polyvinyl butyral | 2.0 | — | 1 |
| 2-5 | 10 | Polyvinyl chloride | 0.4 | Polyvinyl butyral | 2.0 | 2 | 1 |
| 2-6 | 10 | Polyvinyl chloride | 0.4 | Polyvinyl butyral | 2.0 | 2 | 2 |
| 2-7 | 11 | Polyvinyl butyral | 2.0 | Cellulose acetate | 1.5 | — | 1 |
| 2-8 | 12 | Polyvinyl butyral | 2.0 | Cellulose acetate | 1.5 | 2 | 1 |
| 2-9 | 12 | Polyvinyl butyral | 2.0 | Cellulose acetate | 1.5 | 2 | 2 |
| 2-10 | 13 | Polyvinyl butyral | 2.0 | Ethyl cellulose | 0.8 | — | 1 |
| 2-11 | 14 | Polyvinyl butyral | 2.0 | Ethyl cellulose | 0.8 | 2 | 1 |
| 2-12 | 14 | Polyvinyl butyral | 2.0 | Ethyl cellulose | 0.8 | 2 | 2 |

| Test No. | Thermal dev. Cond. | Printing life (sheets) | Smudge in non-image area | Opening of shadow screen | Recovery from smudge (sheets) | Remark |
|---|---|---|---|---|---|---|
| 2-1 | 1 | — | 1 | 1 | Not less than 100 | Comp. |
| 2-2 | 1 | — | 1 | 1 | Not less than 100 | Comp. |
| 2-3 | 2 | — | 1 | 1 | Not less than 100 | Comp. |
| 2-4 | 1 | 1500 | 5 | 5 | 40 | Inv. |
| 2-5 | 1 | 1500 | 6 | 6 | 40 | Inv. |
| 2-6 | 2 | 1200 | 6 | 6 | 40 | Inv. |
| 2-7 | 1 | 1500 | 5 | 6 | 40 | Inv. |
| 2-8 | 1 | 1600 | 6 | 6 | 40 | Inv. |
| 2-9 | 2 | 1200 | 6 | 6 | 40 | Inv. |
| 2-10 | 1 | 1400 | 5 | 6 | 50 | Inv. |
| 2-11 | 1 | 1500 | 6 | 6 | 50 | Inv. |
| 2-12 | 2 | 1100 | 6 | 6 | 50 | Inv. |

As can be seen from Table 2, the samples comprising the composition according to the invention, compared to the comparative samples, are confirmed to be superior in printing life, smudge in non-image area, opening of shadow screen dots and recovery from smudge performance.

Example 3

Preparation of Samples 15 to 30

Sample 15: Sample 15 was prepared in a similar manner as to Sample 4 prepared in Example 1, except that a contrast increasing agent-3 was added to the coating solution-c for the light insensitive layer and the following light-insensitive layer coating solution-5 was coated on the light-sensitive layer to form a light-insensitive layer.

Light-Insensitive Layer Coating Solution-5

| | |
|---|---|
| Polymethyl methacrylate | 0.003 μm |
| an amount to make a dry thickness of the light-insensitive layer | |
| Methyl ethyl ketone | 30 mg/m$^2$ |
| $C_8F_{17}O(CH_2CH_2O)_{22}C_8F_{17}$ | 50 mg/m$^2$ |
| $C_8F_{17}SO_3Li$ | 10 mg/m$^2$ |

Samples 16 to 28, and 30: Samples 16 to 28, and 30 were prepared in a similar manner to Sample 15 described above, except that the kind of a binder and the dry layer thickness were varied as the conditions described in Table 3.

Sample 29: Sample 29 was prepared in a similar manner to Sample 28 above described except that the contrast increasing agent in the light-sensitive layer was removed and replaced by an MEK solution.

All of the main binders of the light-sensitive layer in the samples above described are polyvinyl butyral having a water absorption of 2.0%.

Contrast increasing agent-3

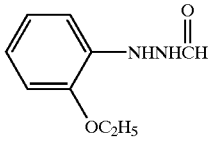

Evaluation of Each Characteristics

The evaluations of printing life, smudge in non-image area, opening of shadow screen dots and recovery of smudge performance with respect to each sample prepared above were performed according to the methods described in Example 1, and the results obtained are shown in Table 3. The method of the thermal development process was followed to the conditions described in Table 3.

TABLE 3

| | | Non-light-sensitive layer | | | |
|---|---|---|---|---|---|
| Test No. | Sample No. | Main binder | Water absop. (%) | Dry film thickness (μm) | Contrast increas. Agent |
| 3-1 | 15 | Polymethyl methacrylate | 0.3 | 0.003 | 1 + 3 |
| 3-2 | 16 | Polymethyl methacrylate | 0.3 | 0.005 | 1 + 3 |
| 3-3 | 17 | Polymethyl methacrylate | 0.3 | 0.1 | 1 + 3 |
| 3-4 | 18 | Polymethyl methacrylate | 0.3 | 0.5 | 1 + 3 |
| 3-5 | 19 | Polymethyl methacrylate | 0.3 | 0.7 | 1 + 3 |
| 3-6 | 20 | Polyvinyl chloride | 0.4 | 0.1 | 1 + 3 |
| 3-7 | 21 | Polyester | 0.2 | 0.1 | 1 + 3 |
| 3-8 | 22 | Styren-acrilonitrile co-polymer | 0.2 | 0.1 | 1 + 3 |
| 3-9 | 23 | Polyvinyl butyral | 2.0 | 0.01 | 1 + 3 |
| 3-10 | 24 | Polyvinyl butyral | 2.0 | 0.02 | 1 + 3 |
| 3-11 | 25 | Polyvinyl butyral | 2.0 | 1.0 | 1 + 3 |
| 3-12 | 26 | Polyvinyl butyral | 2.0 | 1.5 | 1 + 3 |
| 3-13 | 27 | Polyurethane | 1.0 | 1.0 | 1 + 3 |
| 3-14 | 28 | Cellulose nitrate | 1.5 | 1.0 | 1 + 3 |
| 3-15 | 28 | Cellulose nitrate | 1.5 | 1.0 | 1 + 3 |
| 3-16 | 29 | Cellulose nitrate | 1.5 | 1.0 | — |
| 3-17 | 30 | Polyvinyl alcohol | 30.0 | 1.0 | 1 + 3 |

| Test No. | Thermal dev. Cond. | Printing life (sheets) | Smugde in non-image area | Opening of shadow screen | Recovery from smudge (sheets) | Remarks |
|---|---|---|---|---|---|---|
| 3-1 | 1 | 800 | 2 | 3 | 90 | Comp. |
| 3-2 | 1 | 1700 | 6 | 7 | 40 | Inv. |
| 3-3 | 1 | 2000 | 6 | 7 | 40 | Inv. |
| 3-4 | 1 | 2500 | 6 | 7 | 40 | Inv. |
| 3-5 | 1 | 2500 | 6 | 4 | Not less than 100 | Comp. |
| 3-6 | 1 | 2100 | 6 | 7 | 40 | Inv. |
| 3-7 | 1 | 1900 | 6 | 7 | 40 | Inv. |
| 3-8 | 1 | 1900 | 6 | 7 | 40 | Inv. |
| 3-9 | 1 | 1200 | 6 | 6 | 40 | Inv. |
| 3-10 | 1 | 2200 | 6 | 7 | 40 | Inv. |
| 3-11 | 1 | 2600 | 7 | 7 | 40 | Inv. |
| 3-12 | 1 | 2700 | 5 | 7 | 40 | Inv. |
| 3-13 | 1 | 2700 | 6 | 7 | 40 | Inv. |
| 3-14 | 1 | 2600 | 6 | 7 | 40 | Inv. |
| 3-15 | 1 | 2200 | 5 | 6 | 40 | Inv. |
| 3-16 | 1 | 2600 | 6 | 5 | 40 | Inv. |
| 3-17 | 1 | 2800 | 7 | 7 | 40 | Inv. |

As can be seen from Table 3, the samples composing the composition according to the invention, compared to the comparative samples, are proved to be superior in printing life, smudge in non-image area, an opening of shadow screen dots and recovery from smudge performance.

Example 4

Preparation of Samples 31 to 38:

Sample 31: Sample 31 was prepared in a similar manner as to Sample 1 prepared in Example 1, except that the main binder of the light-sensitive layer was changed from polyvinyl chloride to polyester and in addition 100 mg/m$^2$ of carnauba wax (Celozol produced by ChyuKyo-Yushi Co.) was added.

Samples 32 & 33: Samples 32 and 33 were prepared in a similar manner to Sample 31 described above, except that Snowtex-S (produced by Nissan-Kagaku Co.) was added at an amount described in Table 4.

Sample 34: Sample 34 was prepared in a similar manner as to Sample 3 prepared in Example 1, except that 100 mg/m$^2$ of carnauba wax was added to the light-sensitive layer.

Samples 35 & 36: Samples 35 and 36 were prepared in a similar manner to Sample 4 prepared in Example 1, except that Snowtex-S (produced by Nissan-Kagaku Co.) was added at an amount described in Table 4.

Sample 37: Sample 37 was prepared in a similar manner to Sample 36 described above, except that the contrast increasing agent in the light-sensitive layer was removed and replaced by an MEK solution.

Sample 38: Sample 38 was prepared in a similar manner to Sample 36 except that 200 mg/m$^2$ of Sumicorandom AA-5 (alumina, produced by Sumitomo-Kagaku Co.) was added instead of Snowtex.

Evaluation of Each Characteristic:

In addition to the evaluations of printing life, smudge in non-image area, opening of shadow screen dots and recovery from smudge performance with respect to each sample prepared above according to the methods described in Example 1, the measurement of contact angle in the exposed and unexposed portions according to the following method was performed, and the results obtained are shown in Table 4. The thermal development process for each sample was performed according to the conditions described in Table 4.

Measurement of Contact Angle:

The contact angle of each sample after the thermal development was measured in the exposed and unexposed portions and the difference (absolute value) between the two contact angles were calculated. The measurement of the contact angle was performed by the use of a contact angle meter CA-P produced by Kyowa-Kagaku Co., by dropping 0.02 ml of pure water on the surfaces of samples to measure the angle made by the water drop and the sample surface as a contact angle.

TABLE 4

| Test No. | Sample No. | Light-sensitive layer Main binder | Water absop. (%) | Lght-sensitive layer Additives | mg/m$^2$ | Diff. of cont. angle (Δ°) | Cont. increasing agent |
|---|---|---|---|---|---|---|---|
| 4-1 | 31 | Polyester | 0.6 | Carnauba wax | 100 | 0 | 1 |
| 4-2 | 32 | Polyester | 0.6 | Snowtex-S | 70 | 15 | 1 |
| 4-3 | 33 | Polyester | 0.6 | Snowtex-S | 200 | 20 | 1 |
| 4-4 | 34 | Polyvinyl butyral | 2.0 | Carnauba wax | 100 | 5 | — |
| 4-5 | 35 | Polyvinyl butyral | 2.0 | Snowtex-S | 70 | 17 | 1 |
| 4-6 | 36 | Polyvinyl butyral | 2.0 | Snowtex-S | 200 | 22 | 1 |
| 4-7 | 37 | Polyvinyl butyral | 2.0 | Snowtex-S | 200 | 20 | — |
| 4-8 | 36 | Polyvinyl butyral | 2.0 | Snowtex-S<br>Sumicorandum | 200<br>200 | 20<br>25 | 1<br>1 |
| 4-9 | 38 | Polyvinyl butyral | 2.0 | AA-5 | | | |

| Test No. | Thermal dev. Con-d. | Printing life (sheets) | Smudge in non-image area | Opening of shadow screen | Recov-ery from smudge/sheets | Remark |
|---|---|---|---|---|---|---|
| 4-1 | 1 | — | 1 | 1 | Not less than 100 | Comp. |
| 4-2 | 1 | 2000 | 6 | 6 | Not less than 100 | Comp. |
| 4-3 | 1 | 2500 | 7 | 7 | Not less than 100 | Comp. |
| 4-4 | 1 | 800 | 5 | 5 | 60 | Inv. |
| 4-5 | 1 | 2200 | 6 | 6 | 40 | Inv. |
| 4-6 | 1 | 2700 | 67 | 7 | 30 | Inv. |
| 4-7 | 1 | 2600 | 5 | 5 | 30 | Inv. |
| 4-8 | 2 | 2400 | 6 | 6 | 40 | Inv. |
| 4-9 | 1 | 2700 | 7 | 7 | 30 | Inv. |

As can be seen from Table 4, the samples composing the composition according to the invention, compared to the comparative samples, are confirmed to be superior in printing life, smudge in non-image area, opening of shadow screen dots and recovery from smudge performance.

Example 5

Preparation of Samples 39 to 55

Samples 39 to 46: Samples 39 to 46 were prepared in a similar manner to Sample 21 prepared in Example 3, except that the amount of the main binder of the light-insensitive layer was adjusted so to make the dry film thickness as described in Table 5, in addition Snowtex-O, Snowtex-S, Sumicorandom AA-5 or a carnauba wax was added as described in Table 5 to the light-insensitive layer.

Samples 47 to 50: Sample 47 to 50 were prepared in a similar manner to Sample 39 above-described, except that the main binder of the light-insensitive layer was changed to polyvinyl butyral and Snowtex-O to Snowtex-S, and in addition the dry film thickness of the light-insensitive layer was changed as described in Table 5.

Samples 51 to 53: Samples 51 to 53 were prepared in a similar manner to Sample 49 described above, except that the kind and the dry film thickness of the main binder of the light-insensitive layer were changed as described in Table 5.

Sample 54: Sample 54 was prepared in a similar manner to Sample 53 described above, except that the contrast increasing agent in the additive solution-c for the light-sensitive layer was removed and replaced by an MEK solution.

Sample 55: Sample 55 was prepared in a similar manner to Sample 53, except that the items described below were changed.

a; As the support used the following aluminum base material in stead of PET. An aluminum base material 1050 having a thickness of 0.24 mm was degreased with 2 weight % sodium hydroxide solution by being immersed at 50° C. for 30 sec. Then, the material after being subjected to an anodic oxidation treatment using a 20 weight % aqueous solution of sulfuric acid at 25° C. and with a voltage of 20 V to form 0.5 g/m$^2$ of a anodically oxidized film, was washed sufficiently and dried.

b; The back-coating layer was removed.

c; The amount of the infrared dye in the additive solution-a was made to 1.1 g.

Herein, the main binder of the light-sensitive layer in all of above samples is polyvinyl butyral having a water absorption of 2.0%.

The values of the differences between the contact angles of exposed and unexposed portions measured according to the method described in Example 4 are shown in Table 5.

TABLE 5

| Test No. | Sample No. | Light-insensitive layer Main binder | Water absrop. (%) | Dry film thickness (μm) | Additives in light-insensitive layer Kind | mg/m² | Difference of contact angles | Contrast increasing agent |
|---|---|---|---|---|---|---|---|---|
| 5-1 | 39 | Polyester | 0.2 | 0.003 | Snowtex-O | 150 | 20 | 1 + 3 |
| 5-2 | 40 | Polyester | 0.2 | 0.005 | Snowtex-O | 150 | 23 | 1 + 3 |
| 5-3 | 41 | Polyester | 0.2 | 0.1 | Snowtex-O | 150 | 23 | 1 + 3 |
| 5-4 | 42 | Polyester | 0.2 | 0.5 | Snowtex-O | 150 | 23 | 1 + 3 |
| 5-5 | 43 | Polyester | 0.2 | 0.7 | Snowtex-O | 150 | 21 | 1 + 3 |
| 5-6 | 44 | Polyester | 0.2 | 0.1 | Snowtex-S | 150 | 24 | 1 + 3 |
| 5-7 | 45 | Polyester | 0.2 | 0.1 | Sumicarandom AA-5 | 150 | 24 | 1 + 3 |
| 5-8 | 46 | Polyester | 0.2 | 0.1 | Carnauba wax | 150 | 5 | 1 + 3 |
| 5-9 | 47 | Polyvinyl butyral | 2.0 | 0.01 | Snowtex-S | 150 | 26 | |
| 5-10 | 48 | Polyvinyl butyral | 2.0 | 0.02 | Snowtex-S | 150 | 28 | 1 + 3 |
| 5-11 | 49 | Polyvinyl butyral | 2.0 | 1.0 | Snowtex-S | 150 | 28 | 1 + 3 |
| 5-12 | 50 | Polyvinyl butyral | 2.0 | 1.5 | Snowtex-S | 150 | 27 | 1 + 3 |
| 5-13 | 51 | Poly urethane | 1.0 | 1.0 | Snowtex-S | 150 | 25 | 1 + 3 |
| 5-14 | 52 | Cellulose nitrate | 1.5 | 1.0 | Snowtex-S | 150 | 25 | 1 + 3 |
| 5-15 | 53 | Polyvinyl alcohol | 30.0 | 1.0 | Snowtex-S | 150 | 32 | 1 + 3 |
| 5-16 | 53 | Polyvinyl alcohol | 30.0 | 1.0 | Snowtex-S | 150 | 32 | 1 + 3 |
| 5-17 | 54 | Polyvinyl alcohol | 30.0 | 1.0 | Snowtex-S | 150 | 32 | — |
| 5-18 | 55 | Polyvinyl alcohol | 30.0 | 1.0 | Snowtex-S | 150 | 32 | 1 + 3 |

Evaluation of Each Characteristic

The evaluation of printing life, smudge in non-image area, opening of shadow screen dots and recovery from smudge performance with respect to each sample prepared above were performed according to the methods described in Example 1, and the results obtained are shown in Table 6. The thermal development process was performed according to the conditions described in Table 6.

TABLE 6

| Test No. | Sample No. | Thermal Development Condition | Printing life (sheets) | Smudge in non-image area | Opening of shadow screen | Recovery from smudge (sheets) |
|---|---|---|---|---|---|---|
| 5-1 | 39 | 1 | 2100 | 5 | 5 | 60 |
| 5-2 | 40 | 1 | 2300 | 6 | 7 | 30 |
| 5-3 | 41 | 1 | 2500 | 6 | 7 | 30 |
| 5-4 | 42 | 1 | 2700 | 6 | 7 | 30 |
| 5-5 | 43 | 1 | 2500 | 6 | 4 | 40 |
| 5-6 | 44 | 1 | 2800 | 6 | 7 | 30 |
| 5-7 | 45 | 1 | 2900 | 6 | 7 | 30 |
| 5-8 | 46 | 1 | 600 | 5 | 5 | 60 |
| 5-9 | 47 | 1 | 2400 | 7 | 7 | 30 |
| 5-10 | 48 | 1 | 2800 | 8 | 8 | 30 |
| 5-11 | 49 | 1 | 2900 | 8 | 8 | 30 |
| 5-12 | 50 | 1 | 2700 | 7 | 7 | 30 |
| 5-13 | 51 | 1 | 2700 | 7 | 7 | 30 |
| 5-14 | 52 | 1 | 2600 | 7 | 7 | 30 |
| 5-15 | 53 | 1 | 3200 | 9 | 9 | 20 |
| 5-16 | 53 | 2 | 2900 | 9 | 7 | 20 |
| 5-17 | 54 | 1 | 3100 | 8 | 8 | 20 |
| 5-18 | 55 | 1 | 4000 | 9 | 9 | 20 |

As can be seen from Table 6, the samples comprising the composition according to the invention, compared to the comparative samples, are proved to be superior in printing life, smudge in non-image area, an opening of shadow screen dots and recovery from smudge performance. Further, Sample 55 using the aluminum base material is proved to have more superior printing life.

The Effect of the Invention

The invention can provide the thermally developable photothermographic graphic arts material having a superior characteristics in smudge of non-image area, opening of a shadow screen dots, recovery from smudge, as well as sufficient printing life, the printing plate utilizing the material and the preparation method thereof.

What is claimed is:

1. A photothermographic light-sensitive material for making a printing plate comprising a support having thereon a light-sensitive layer containing light-sensitive silver halide grains, organic silver salt grains, a reducing agent and a binder, wherein the organic silver salt grain comprises an organic silver salt having 10 or more of carbon atoms, and the light-sensitive layer is the outermost layer and has a coefficient of water absorption of not less than 0.7%.

2. The photothermographic light-sensitive material of claim 1, wherein the coefficient of water absorption of the outermost layer is within a range of 1.5% to 50%.

3. The photothermographic light-sensitive material of claim 1, wherein the light-sensitive layer has a contrast increasing agent.

4. A photothermographic light-sensitive material for making a printing plate comprising a support having thereon a light-sensitive layer containing light-sensitive silver halide grains, organic silver salt grains, a reducing agent and a binder and an outermost light-insensitive layer on the light-sensitive layer, wherein the organic silver salt grains comprise a organic silver salt having 10 or more of carbon atoms and the light-sensitive layer has a coefficient of water absorption of not less than 0.7% and the outermost light-insensitive layer has a coefficient of water absorption of not more than 0.7% and a thickness within a range of 0.005 $\mu$m to 0.5 $\mu$m.

5. The photothermographic light-sensitive material of claim 4, wherein the light-sensitive layer has a contrast increasing agent.

6. The photothermographic light-sensitive material of claim 5, wherein thickness of the light-insensitive layer is with in a range of 0.01 $\mu$m to 0.2 $\mu$m.

* * * * *